US012534280B2

(12) United States Patent
Sueoka et al.

(10) Patent No.: US 12,534,280 B2
(45) Date of Patent: Jan. 27, 2026

(54) PACKAGING BAG

(71) Applicant: KYORAKU CO., LTD., Kyoto (JP)

(72) Inventors: Masaaki Sueoka, Tokyo (JP); Shun Morioka, Tokyo (JP); Yosuke Muroya, Yamato (JP)

(73) Assignee: KYORAKU CO., LTD., Kyoto (JP)

( * ) Notice: Subject to any disclaimer, the term of this patent is extended or adjusted under 35 U.S.C. 154(b) by 85 days.

(21) Appl. No.: 18/003,217

(22) PCT Filed: Jun. 24, 2021

(86) PCT No.: PCT/JP2021/023903

§ 371 (c)(1),
(2) Date: Jun. 2, 2023

(87) PCT Pub. No.: WO2022/004542

PCT Pub. Date: Jan. 6, 2022

(65) Prior Publication Data

US 2023/0356905 A1 Nov. 9, 2023

(30) Foreign Application Priority Data

Jun. 30, 2020 (JP) ..... 2020-112984
Jul. 31, 2020 (JP) ..... 2020-130945
(Continued)

(51) Int. Cl.
*B65D 75/00* (2006.01)
*B65D 33/25* (2006.01)
(Continued)

(52) U.S. Cl.
CPC ..... *B65D 75/008* (2013.01); *B65D 33/2508* (2013.01); *B65D 77/245* (2013.01);
(Continued)

(58) Field of Classification Search
CPC ..... B65D 75/008; B65D 33/2508; B65D 77/245; B65D 81/3461; B65D 33/02; B65D 33/08
(Continued)

(56) References Cited

U.S. PATENT DOCUMENTS 3,679,093 A * 7/1972 Chang ..... A47G 19/03 229/125.05
3,935,993 A * 2/1976 Doyen ..... B65D 75/008 383/122
(Continued)

FOREIGN PATENT DOCUMENTS

CN 203975478 U 12/2014
JP H07-13774 U 3/1995
(Continued)

OTHER PUBLICATIONS

International Search Report issued on Sep. 14, 2021 in corresponding International application No. PCT/JP2021/023903; 11 pages.
(Continued)

*Primary Examiner* — Peter N Helvey
(74) *Attorney, Agent, or Firm* — Maier & Maier, PLLC

(57) ABSTRACT

A self-standing packaging bag for use in a microwave oven. The packaging bag is made of a flexible film formed into a bag shape, the packaging bag includes a bottom surface portion and a peripheral surface portion provided to rise from the bottom surface portion, the peripheral surface portion includes a front surface portion and a back surface portion facing each other and includes an opening that opens upward, the peripheral surface portion includes an openable member configured to open and close the opening, and an opening portion for opening the packaging bag, the opening portion is provided closer to the bottom surface portion than the openable member, a container-shaped main body portion obtained by tearing the peripheral surface portion in a circumferential direction at the opening portion and remov-
(Continued)

ing a tear-off portion above the opening portion is usable as a dish when eating contents in the packaging bag.

4 Claims, 25 Drawing Sheets

(30) Foreign Application Priority Data

Jul. 31, 2020 (JP) ..... 2020-130951
Dec. 21, 2020 (JP) ..... 2020-211565

(51) Int. Cl.
*B65D 77/24* (2006.01)
*B65D 81/34* (2006.01)
*B65D 33/02* (2006.01)
*B65D 33/08* (2006.01)

(52) U.S. Cl.
CPC ..... *B65D 81/3461* (2013.01); *B65D 33/02* (2013.01); *B65D 33/08* (2013.01)

(58) Field of Classification Search
USPC ..... 383/200
See application file for complete search history.

(56) References Cited

U.S. PATENT DOCUMENTS 4,138,014 A * 2/1979 Bouman ..... B65D 81/3261 426/115
4,615,045 A * 9/1986 Siegel ..... B65D 33/2533 493/215
4,818,122 A * 4/1989 Arbuthnot ..... A62B 25/00 383/41
4,930,637 A * 6/1990 DeRoseau ..... A47G 21/00 206/541
4,993,845 A * 2/1991 Faltynek ..... B65D 31/12 383/111
5,075,119 A * 12/1991 Mendenhall ..... B65D 81/3469 426/118
5,090,572 A * 2/1992 DeRoseau ..... B65D 81/3216 206/541
5,251,758 A * 10/1993 Kolacek ..... B65D 51/247 428/905
5,727,679 A * 3/1998 Newarski ..... B65D 81/3205 206/541
5,947,289 A * 9/1999 Stridsberg ..... B65D 77/28 206/467
6,245,367 B1 * 6/2001 Galomb ..... B65D 75/008 206/541
6,254,907 B1 * 7/2001 Galomb ..... B65D 81/3261 206/541
6,629,609 B2 * 10/2003 Cook ..... B65D 5/44 206/362.4
6,719,140 B1 * 4/2004 Rinsler ..... A45C 11/20 206/541
9,346,589 B2 * 5/2016 Bunton ..... B65D 33/08
D764,932 S * 8/2016 Joswick ..... D9/702
9,527,629 B2 * 12/2016 Kondo ..... B65D 33/01
10,472,131 B2 * 11/2019 Martial ..... B65D 33/255
10,710,789 B2 * 7/2020 Schur ..... B65D 33/2508
11,661,261 B2 * 5/2023 Mishkin ..... B65D 81/3484 426/114
D1,044,514 S * 10/2024 Bertelsman ..... D9/702
2001/0029226 A1 10/2001 Ichikawa et al.
2005/0013905 A1 * 1/2005 Hughes ..... B65D 75/5805 426/106
2005/0157956 A1 * 7/2005 Geyer ..... B65D 33/18 383/17
2005/0173053 A1 8/2005 Ichikawa et al.
2005/0281487 A1 * 12/2005 Pawloski ..... B65D 33/10 383/63
2006/0204148 A1 * 9/2006 Kohn ..... B65D 33/001 383/104
2006/0210199 A1 * 9/2006 Ali ..... B65D 75/5866 383/906
2007/0110856 A1 * 5/2007 Kanzaki ..... B65D 77/225 426/107
2008/0107781 A1 * 5/2008 Carroll ..... B65D 31/12 426/106
2009/0035424 A1 * 2/2009 Mita ..... B32B 27/36 426/118
2009/0314773 A1 * 12/2009 Kanzaki ..... B65D 77/225 219/733
2011/0035946 A1 * 2/2011 Menceles ..... A47G 21/02 383/127
2011/0038564 A1 * 2/2011 Slansky ..... B65D 33/004 383/106
2012/0207412 A1 * 8/2012 Moehlenbrock ..... B65B 9/06 383/105
2013/0236128 A1 * 9/2013 Bray ..... B65D 31/02 383/69
2014/0072247 A1 * 3/2014 McDonough ..... B65D 33/243 383/65
2014/0120207 A1 * 5/2014 Steele ..... A47G 21/12 206/548
2016/0023809 A1 * 1/2016 Leeker ..... B65B 9/2056 493/227
2016/0152381 A1 * 6/2016 Kreymborg ..... B65D 33/08 383/10
2018/0290799 A1 * 10/2018 Sedgwick ..... A47G 19/06
2018/0346223 A1 * 12/2018 Skaggs ..... B65D 77/245
2018/0346226 A1 * 12/2018 Burke ..... B65D 75/563
2021/0163183 A1 * 6/2021 Reilly ..... B65D 33/01
2023/0339655 A1 * 10/2023 Clottin-Basini ..... B65D 85/72

FOREIGN PATENT DOCUMENTS

JP 2005178813 A 7/2005
JP 2005-306426 A 11/2005
JP 2007-119076 A 5/2007
JP 2008-081170 A 4/2008
JP 2008-285190 A 11/2008
JP 2010-036968 A 2/2010
JP 2016-137929 A 8/2016
JP 2017-081593 A 5/2017
JP 2019-001550 A 1/2019
JP 2020-033026 A 3/2020

OTHER PUBLICATIONS

Office Action issued on Apr. 8, 2025, in corresponding Chinese Application No. 202180044372.2, 34 pages.
Office Action issued on Jul. 30, 2024, in corresponding Japanese Application No. 2020-211565, 7 pages.

* cited by examiner

Fig. 3A
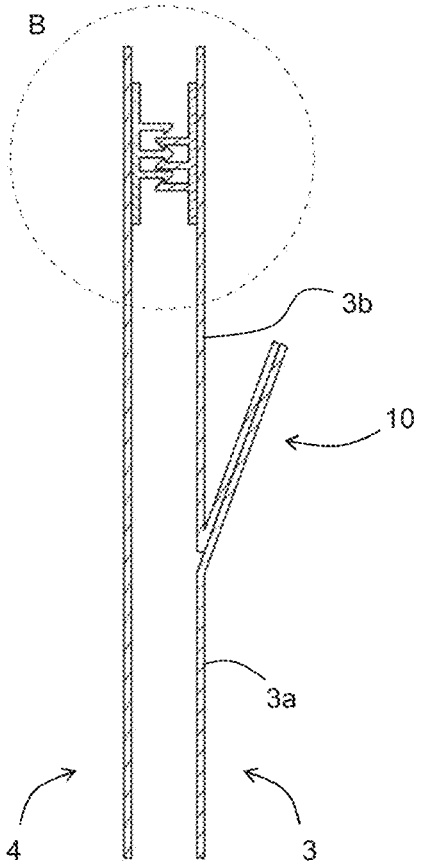
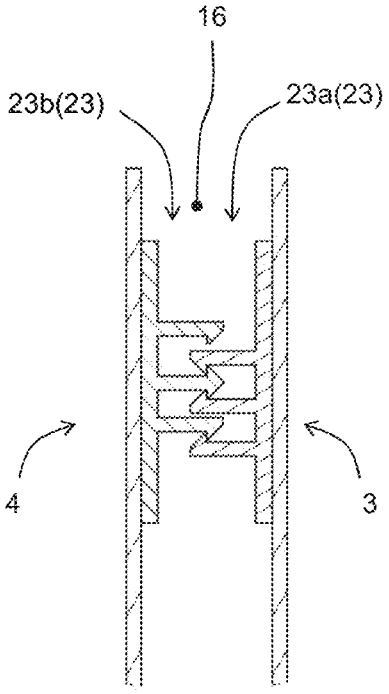
Fig. 3B
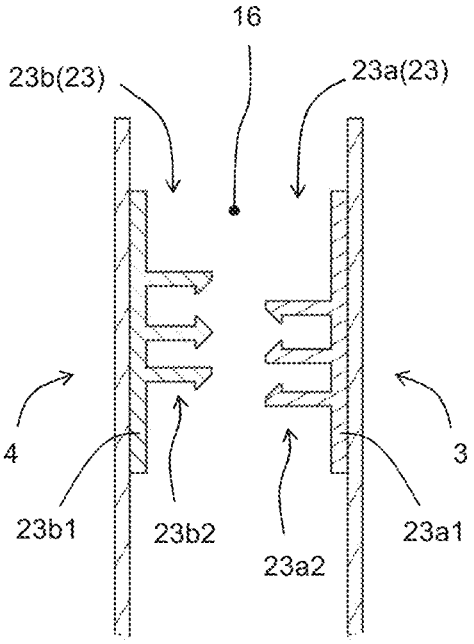
Fig. 3C

PACKAGING BAG

FIELD

The present invention relates to a self-standing packaging bag for use in a microwave oven, which is made of a flexible film formed into a bag shape.

BACKGROUND

First Viewpoint

Patent Literature 1 discloses a packaging bag for use in a microwave oven, which has an openable and closable occlusion portion.

Second and Third Viewpoint

Packaging bags filled with contents such as retort pouch food, etc., which can be heated in a freestanding state in a microwave oven, etc., are known. For example, the packaging bag of Patent Document 2 has excellent display effects in stores because of its self-standing stability.

PATENT LITERATURE

Patent Literature 1: JP-A-2016-137929
Patent Literature 2: JP-A-2005-306426

SUMMARY

First Viewpoint

Using the packaging bag of Patent Literature 1, any contents can be heated by opening the occlusion portion and placing the contents to be heated inside the packaging bag. In the configuration of Patent Literature 1, it is assumed that after heating the contents, the contents are transferred to a dish for eating through an opening formed by opening the occlusion portion.

However, in such a configuration, when the contents are transferred to a dish, they may be caught in the occlusion portion, making it difficult to transfer the contents.

The present invention has been made in view of such circumstances and provides a packaging bag for use in a microwave oven that can easily accommodate contents inside and allows the contents to be easily eaten after heating.

Second and Third Viewpoint

On the other hand, it is conceivable to use the container-like body portion obtained by removing the cut-out portion above the opening portion as a tableware for eating the contents. In such cases, there was room for improvement in terms of user convenience.

The second aspect of the present invention was made in view of these circumstances, and is to provide a microwave packaging bag that is highly convenient for users when used as tableware.

The third aspect of the present invention was made in view of these circumstances, and is to provide a microwave packaging bag that is highly convenient for users when used to contain liquid substances and used as tableware.

First Viewpoint

According to the present invention, provided is a self-standing packaging bag for use in a microwave oven, wherein the packaging bag is made of a flexible film formed into a bag shape, the packaging bag comprises a bottom surface portion and a peripheral surface portion provided so as to rise from the bottom surface portion, the peripheral surface portion comprises a front surface portion and a back surface portion facing each other and comprises an opening that opens upward, the peripheral surface portion comprises an openable member configured to open and close the opening, and an opening portion for opening the packaging bag, the opening portion is provided closer to the bottom surface portion than the openable member, and a container-shaped main body portion obtained by tearing the peripheral surface portion in a circumferential direction at the opening portion and removing a tear-off portion above the opening portion is usable as a dish when eating contents in the packaging bag.

Since the packaging bag of the present invention is configured to be opened and closed by the openable member, the contents can be easily accommodated in the packaging bag. Further, after heating the contents accommodated inside, the container-shaped main body portion obtained by tearing the peripheral surface portion in a circumferential direction at the opening portion and removing the tear-off portion above the opening portion is usable as a dish. The openable member is provided in the tear-off portion and is thus removed when opening the packaging bag at the opening portion. Therefore, the openable member does not interfere with eating the contents, and the contents can be easily eaten.

In the packaging bag of the present invention, the upper side of the packaging bag can be closed without using a heat sealing device after the contents are accommodated in the packaging bag. Therefore, it can be suitably used, for example, in takeout application, where a restaurant or the like sells food after accommodating it in the packaging bag and then closing the openable member.

Hereinafter, various embodiments of the present invention will be exemplified. The embodiments shown below can be combined with each other.

Preferably, the bottom surface portion, the front surface portion, and the back surface portion are welded to each other to form the bag shape.

Preferably, the packaging bag is configured to open wider in a front-back direction at a center lower end than at a side lower end, the center lower end being a lower end of a center portion of the packaging bag in a left-right direction, the side lower end being a lower end of a side portion of the packaging bag in the left-right direction.

Preferably, the openable member comprises a front-side engagement member and a back-side engagement member configured to be able to engage with each other, the front-side engagement member is fixed on an inner surface side of the front surface portion, and the back-side engagement member is fixed on an inner surface side of the back surface portion.

Preferably, an upper end of the front surface portion is provided with a first protruding portion protruding upward, and an upper end of the back surface portion is provided with a second protruding portion protruding upward.

Preferably, the front surface portion comprises a lower front surface portion and an upper front surface portion, the lower front surface portion is welded to the bottom surface portion, and the lower front surface portion and the upper front surface portion are welded to each other at a joint portion formed by overlapping an inner surface of the lower front surface portion and an inner surface of the upper front surface portion in a state that the lower front surface portion and the upper front surface portion are both folded back.

Preferably, the joint portion comprises a third protruding portion protruding from an upper end of the front surface portion in a state where the joint portion is inclined toward an upper end side of the front surface portion.

Preferably, the peripheral surface portion is provided with a vapor release seal portion configured to form a vapor flow path as internal pressure rises.

Preferably, the opening portion is provided closer to the bottom surface portion than the vapor release seal portion.

Preferably, the opening portion a tear start portion configured to serve as a starting point for tearing the peripheral surface portion.

(Second Viewpoint)

According to the present invention, there is provided a packaging bag for microwave ovens in which a flexible film is formed into a bag shape, and to which is attached a tool to be used when eating the contents inside said packaging bag.

This configuration allows users to eat the contents using utensils attached to the packaging bag, eliminating the need to go to the trouble of facilitating the utensils. This improves user convenience when used as tableware.

Hereinafter, various embodiments of the present invention will be exemplified. The embodiments shown below can be combined with each other.

Preferably, said packaging bag has a bottom, a front, and a back portion, said front and back portions facing each other and rising from said bottom portion, and said tool is attached to said bottom portion.

Preferably, said packaging bag has a bottom portion, a front portion, and a back portion, said front portion and said back portion are provided facing each other and rising from said bottom portion, and a space is provided at either end of said packaging bag in the left or right direction to accommodate said tools.

Preferably, said packaging bag has a bottom portion and a peripheral portion provided so as to rise from said bottom portion, said peripheral portion having a front portion and a back portion facing each other and an opening upwardly, and the upper portion of said packaging bag is provided with a space for accommodating said tools.

Preferably, the lower portion of said space is provided with openings that are connected to the front and back of said packaging bag, and said packaging bag is configured to be graspable with each tool housed in said space.

Preferably, the lower part of said space is provided with an opening member configured to open and close said opening.

Third Viewpoint

According to the present invention, there is provided a packaging bag for a freestanding microwave oven in which a flexible film is formed into a bag shape, said packaging bag having a bottom portion and a peripheral portion provided to rise from said bottom portion, and a reinforcing member is attached to the inner surface of said peripheral portion to reinforce the rigidity of said peripheral portion over the circumference of said peripheral portion.

This configuration improves the self-supporting stability and graspability of the packaging bag by means of the reinforcement attached to the periphery. This improves user convenience when used as a tableware for eating liquid food.

Hereinafter, various embodiments of the present invention will be exemplified. The embodiments shown below can be combined with each other.

Preferably, said peripheral portion is provided with a front and back portion facing each other and having an upwardly opening, and said peripheral portion is provided with an openable member configured to open and close said opening and a plurality of opening portions for opening said packaging bag, said opening portions being one position closer to said bottom portion than said openable member and one position further from said bottom portion than said openable member. and one at a position further away from said bottom portion than said opening/closing member.

Preferably, the lower end of said reinforcing member and the inner surface of said peripheral portion are welded together around the periphery of said peripheral portion.

Preferably, when the length from the bottom edge of said packaging bag to said opening portion is H2 and the vertical length of said reinforcing member is H, $H/H2 \geq 0.3$.

Preferably, said reinforcing member is provided with a heat insulator.

BRIEF DESCRIPTION OF THE DRAWINGS

First Viewpoint

FIG. 3A is a cross-sectional view taken along a A-A line in FIG. 2.

FIG. 3B is an enlarged view of a region B in FIG. 3A FIG. 3C shows a state where an openable member 23 in FIG. 3B is opened.

(Second Viewpoint)

Figure 12A:
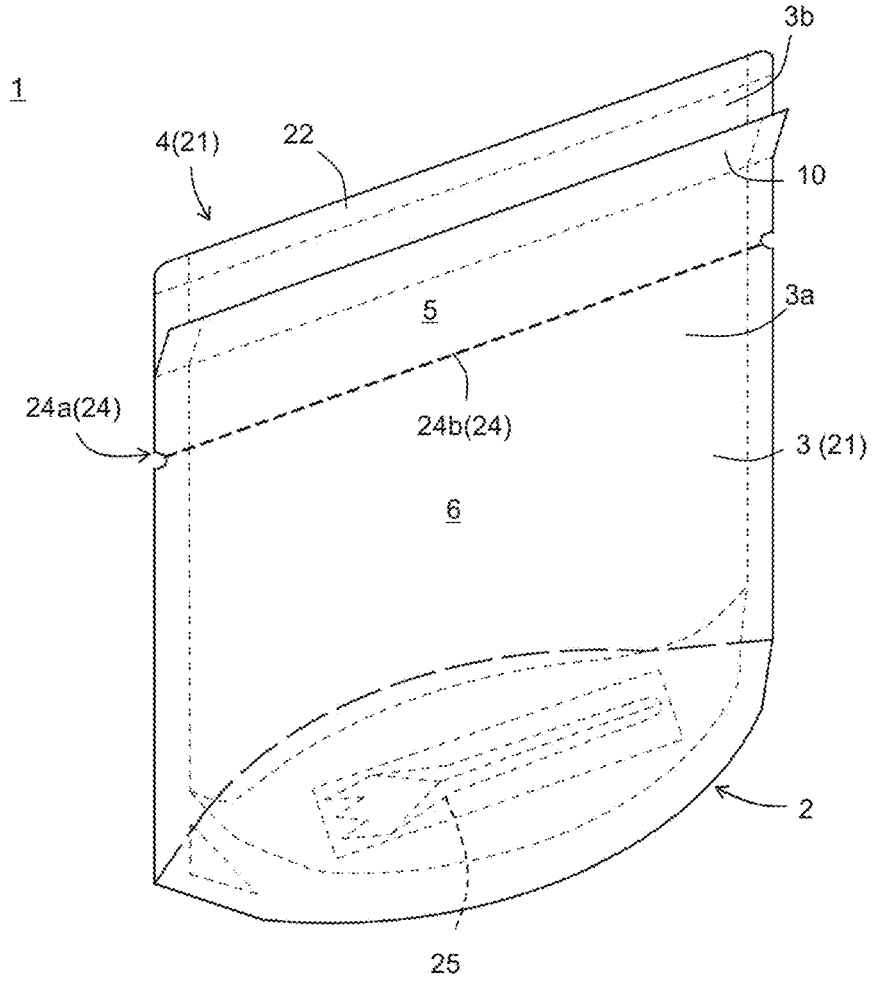

FIG. 12A is a diagram of the first embodiment of the packaging bag 1 with the contents contained within.

Figure 12B:
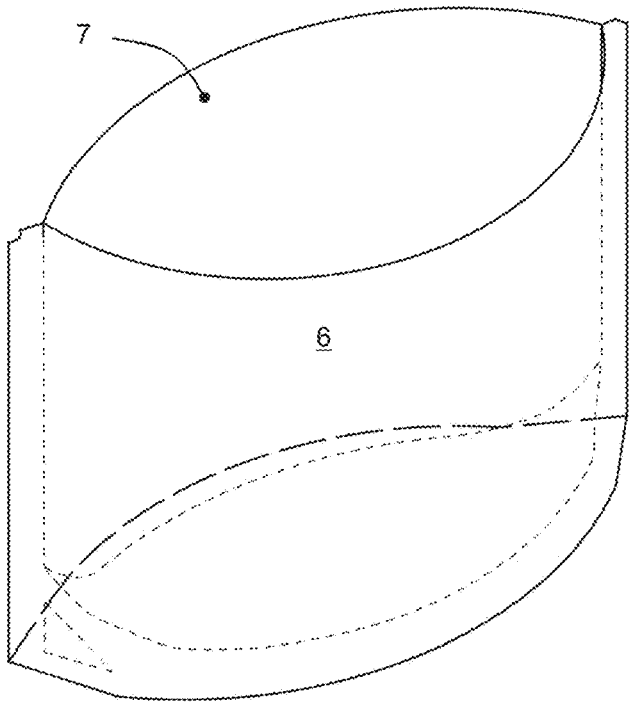

FIG. 12B is a diagonal view of the packaging bag 1 in the opened state.

Figure 13:
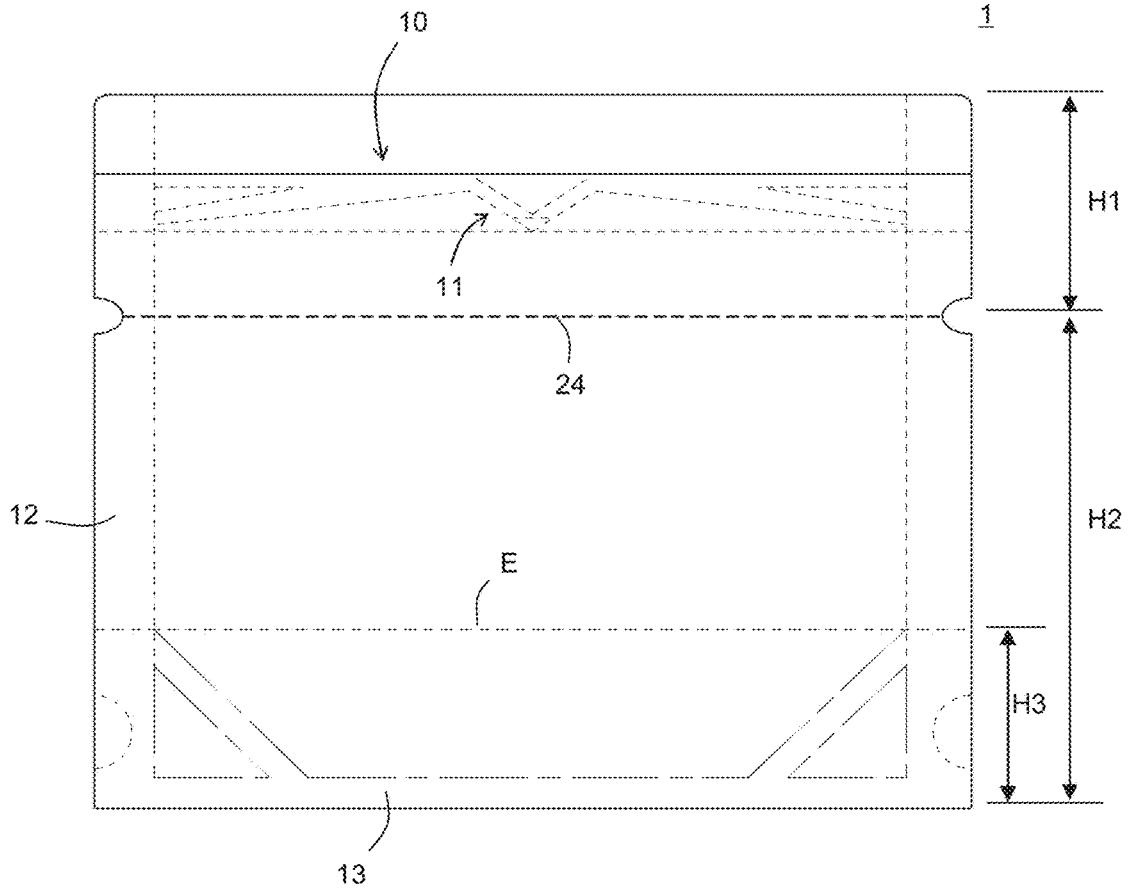

FIG. 13 shows a plan view of the packaging bag 1 before the tool 25 is attached.

Figure 14A:
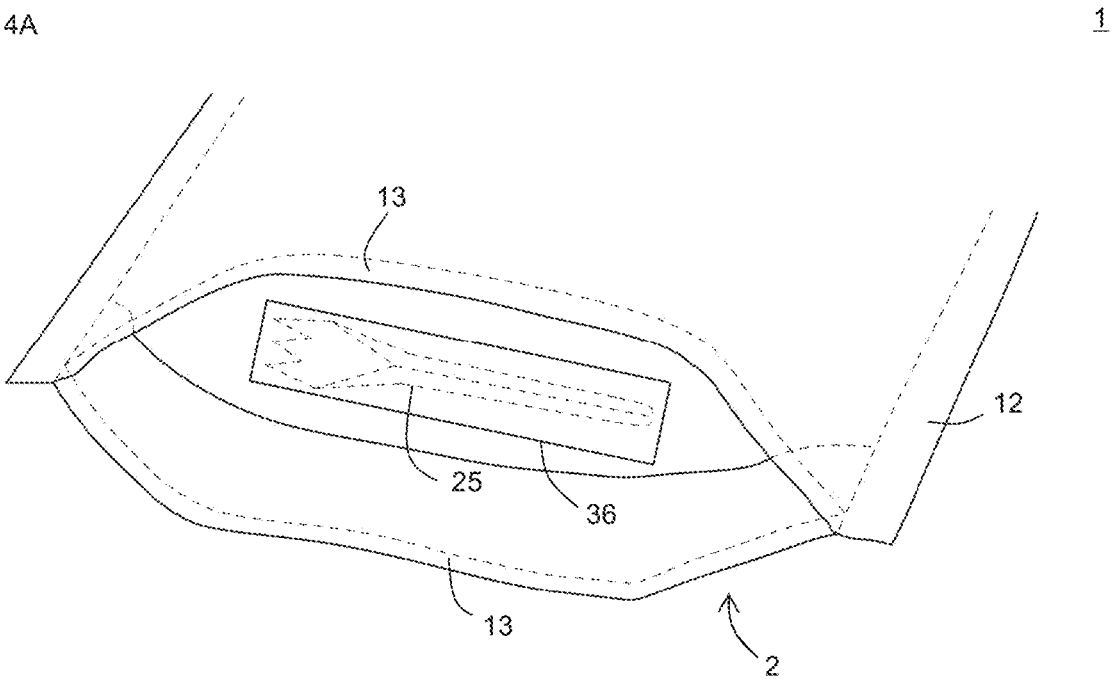

FIG. 14A is a diagram of the bottom portion 2 with the tool 25 attached to the packaging bag 1.

Figure 14B:
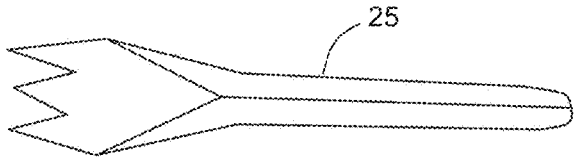

FIG. 14B is a plan view of the tool 25.

Figure 14C:
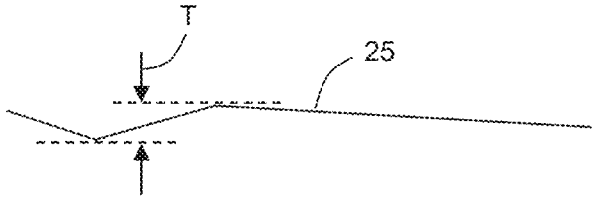

FIG. 14C is a side view of the tool 25.

Figure 15:
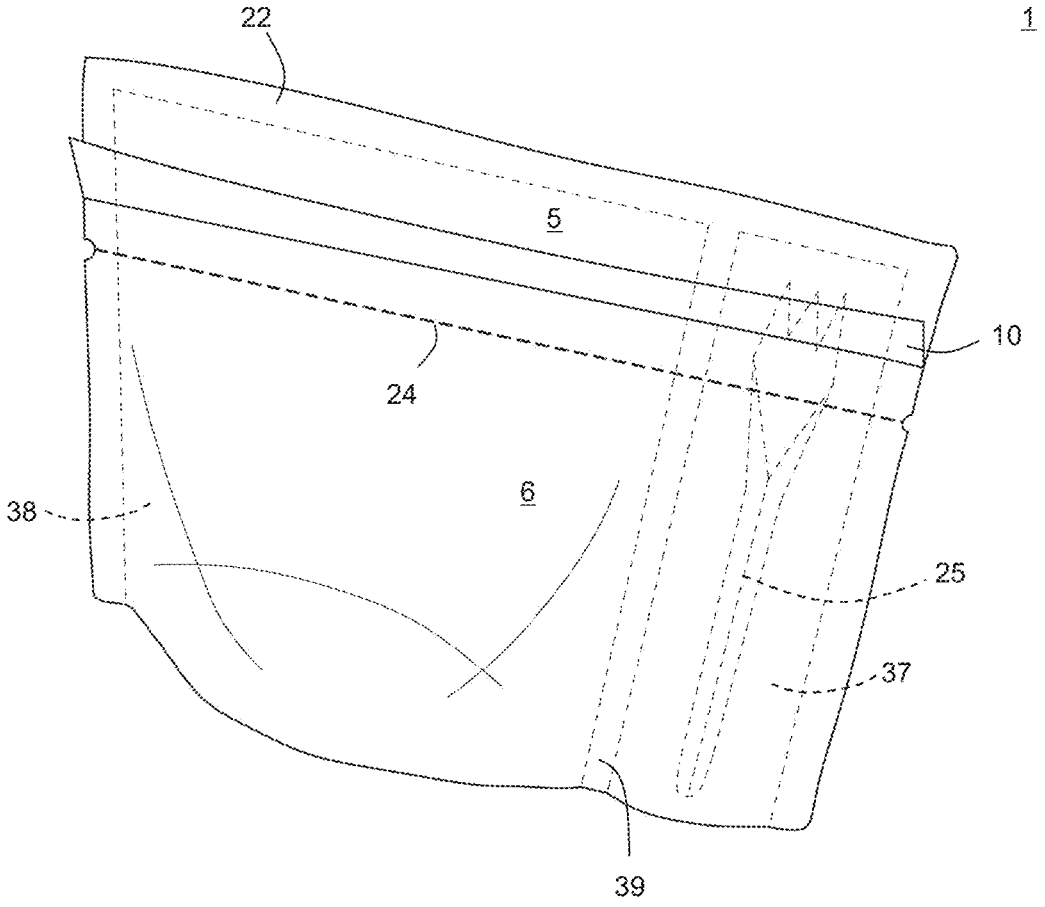

FIG. 15 is a diagram of the packaging bag 1 of the second embodiment.

Figure 16:
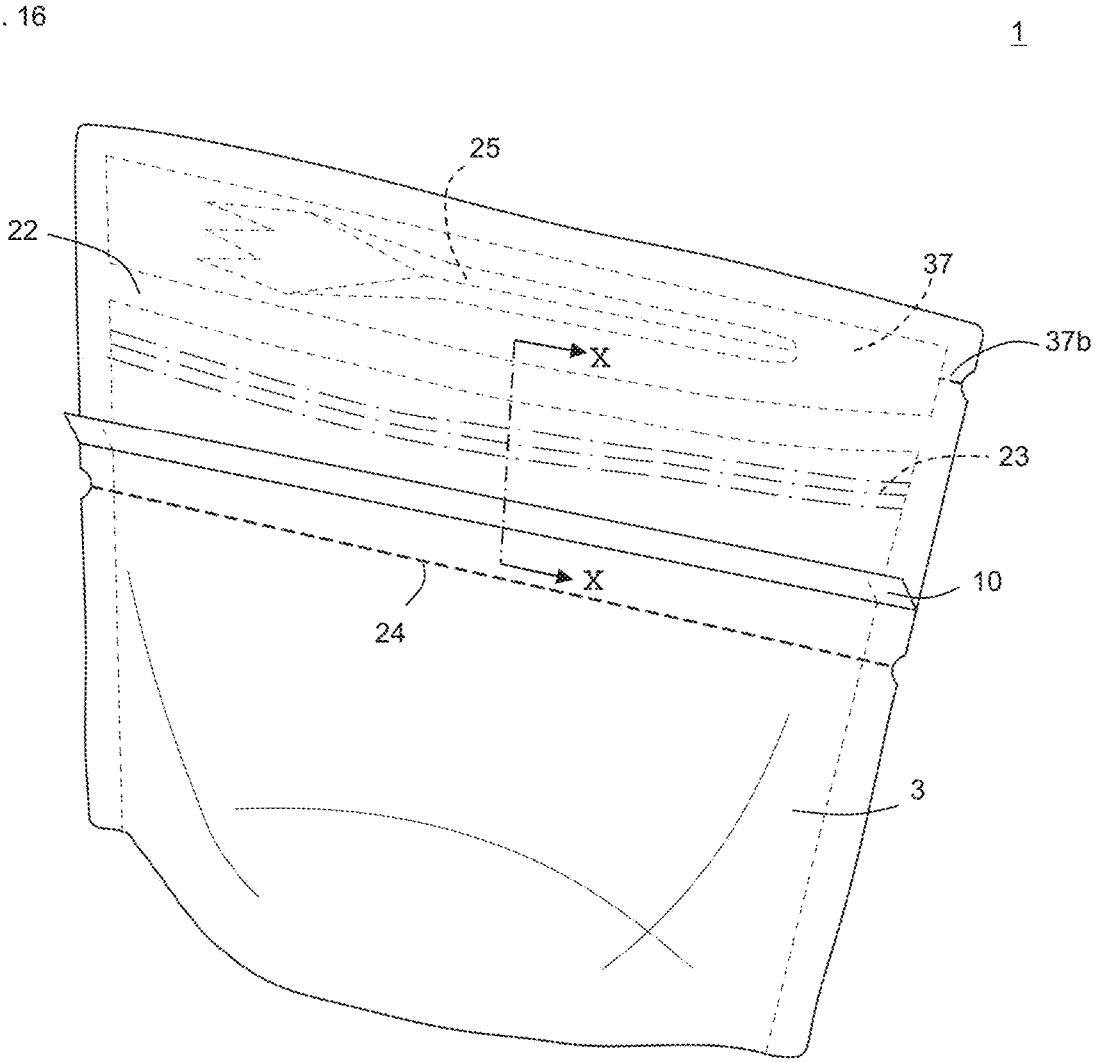

FIG. 16 is a diagram of the third embodiment of the packaging bag 1.

Figure 17:
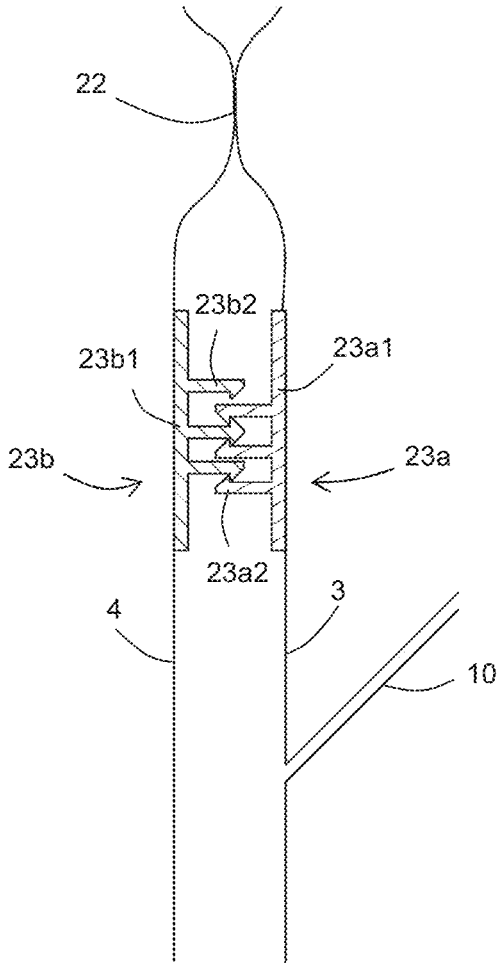

FIG. 17 is an X-X cross-sectional view of FIG. 16.

Figure 18:
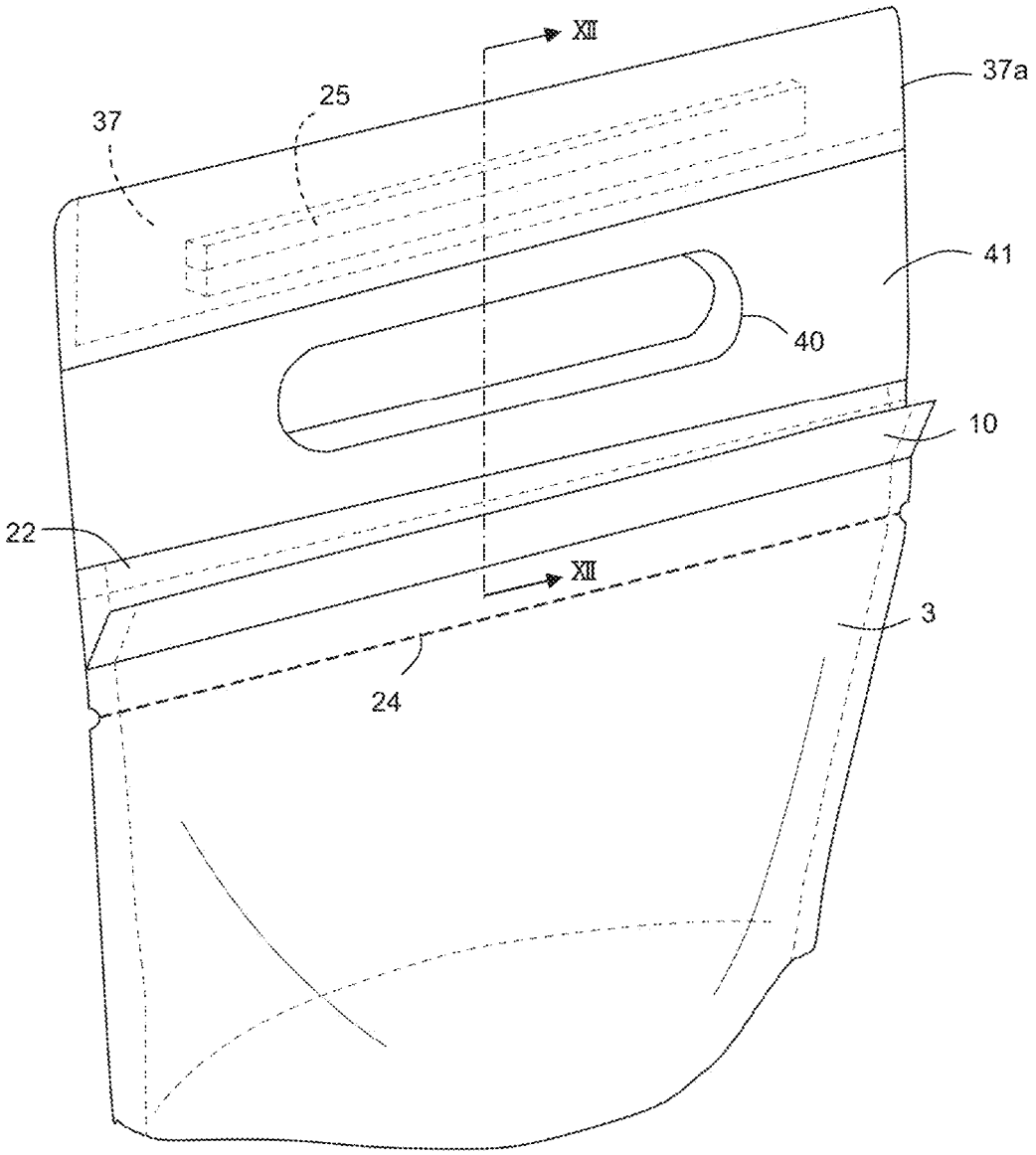

FIG. 18 is a diagram of the fourth embodiment of packaging bag 1.

Figure 19:
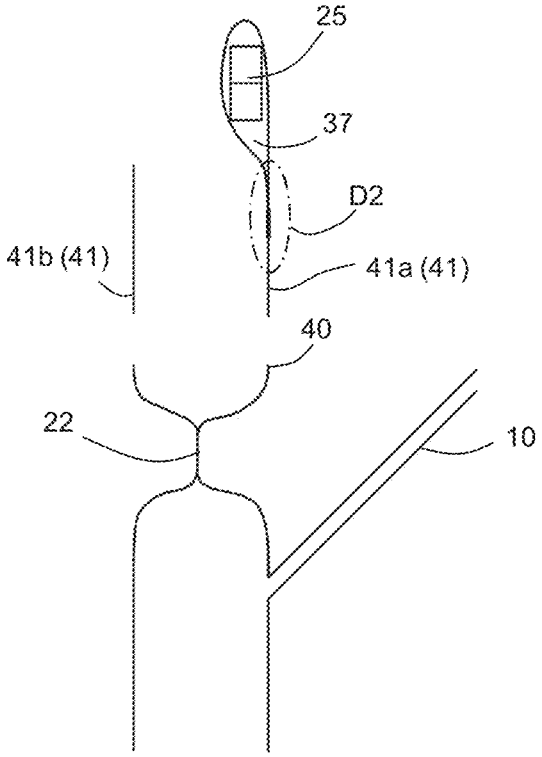

FIG. 19 is a XII-XII cross-sectional view of FIG. 18.

Figure 20:
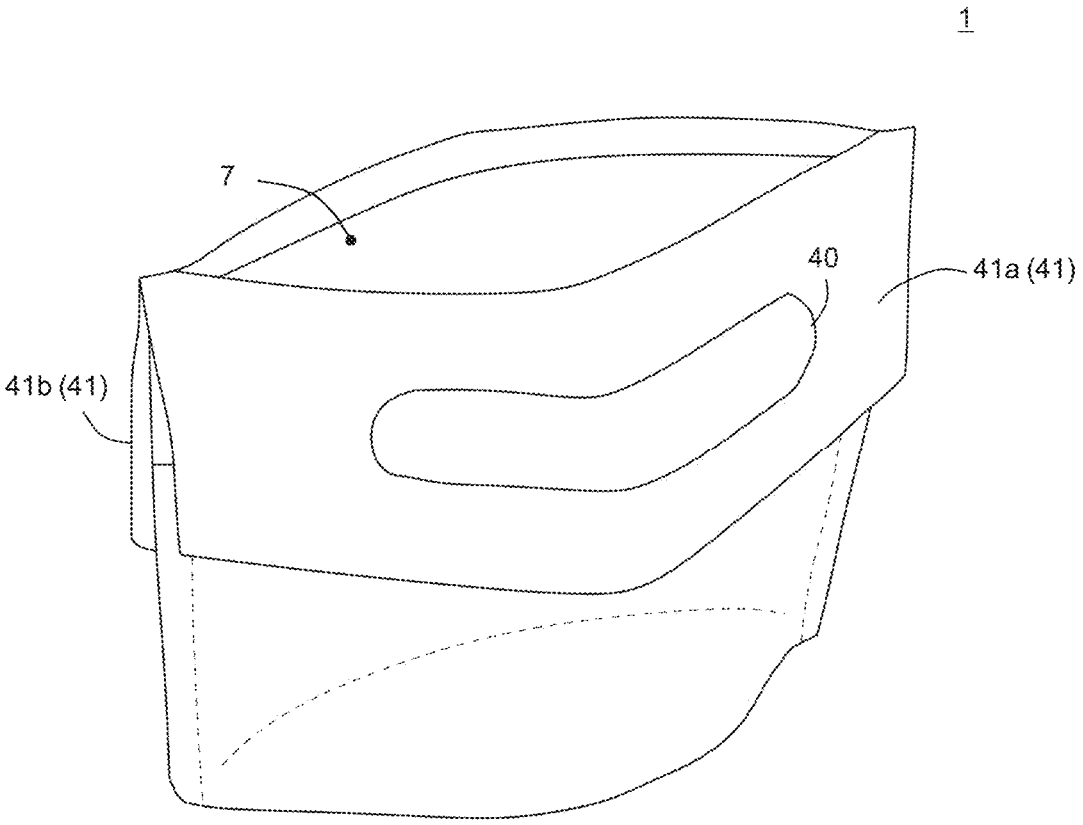

FIG. 20 shows the form of the fourth embodiment of the packaging bag 1 when the contents are placed inside the packaging bag 1.

Third Viewpoint

Figure 21:
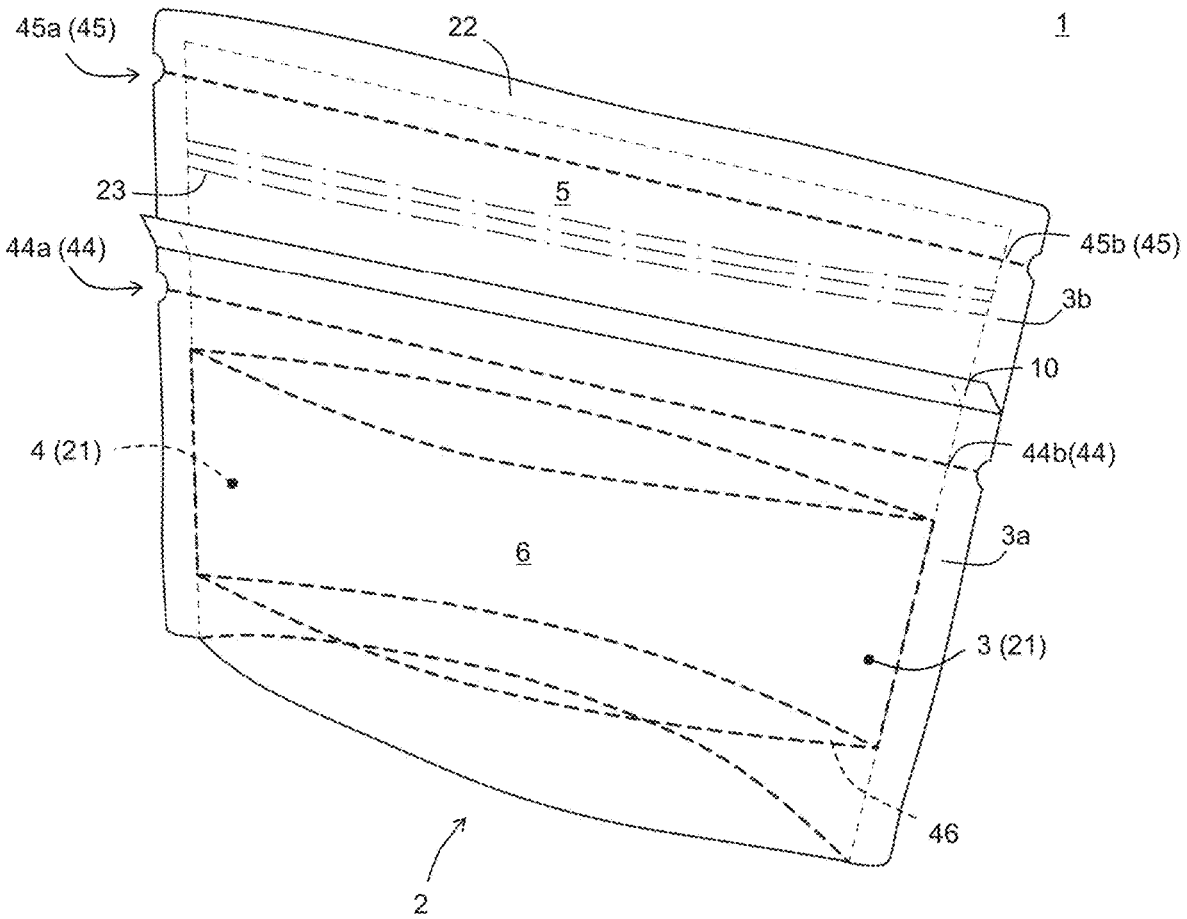

FIG. 21 is a diagram of the first embodiment of the packaging bag 1 with the contents contained within.

Figure 22:
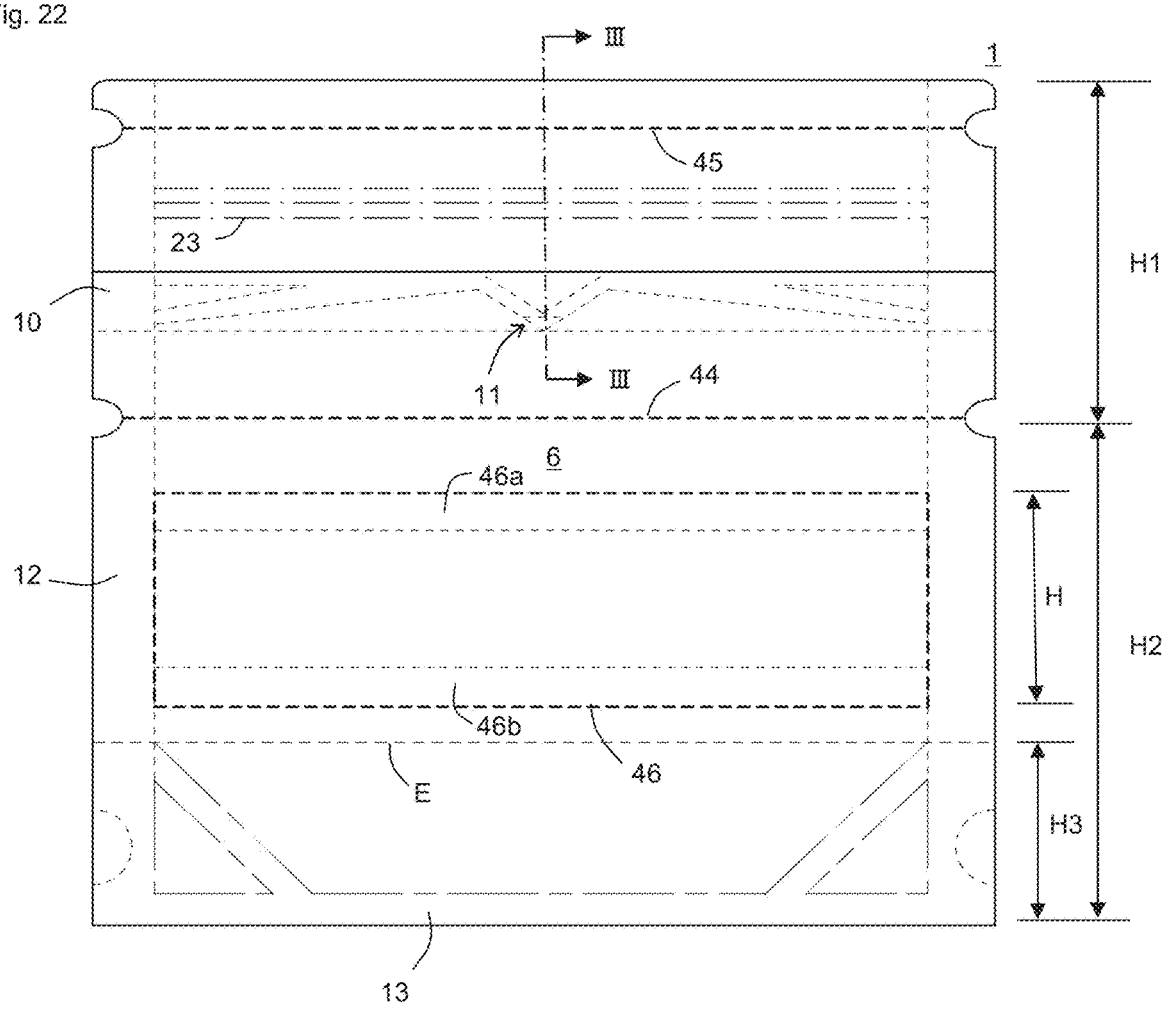

FIG. 22 shows the packaging bag 1 in plan view.

Figure 23A:
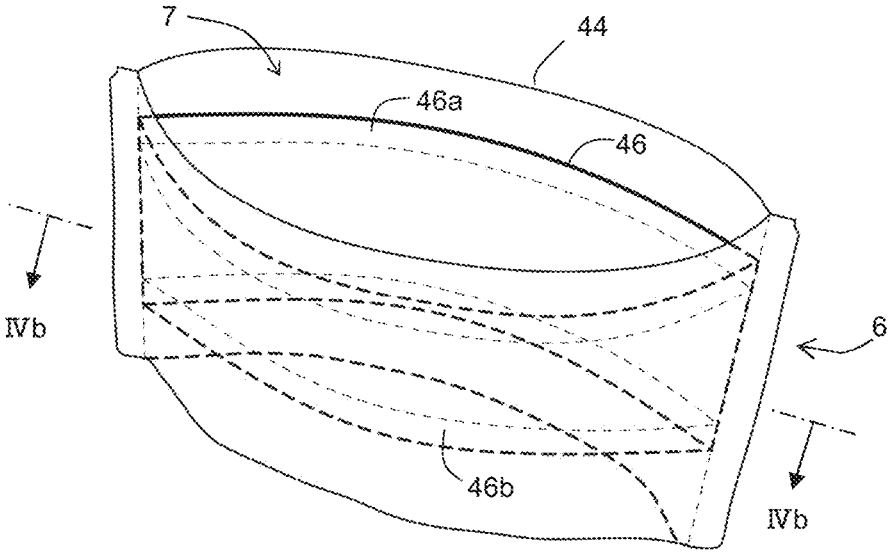

FIG. 23A is a diagram of the packaging bag 1 opened at the first opening 44.

Figure 23B:
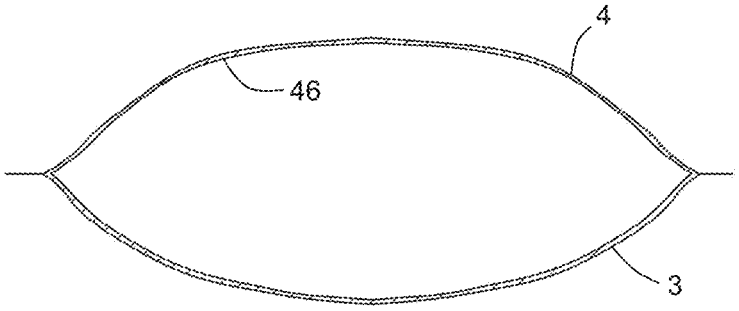

FIG. 23B is a sectional view of IVb-IVb in FIG. 23A.

Figure 23C:
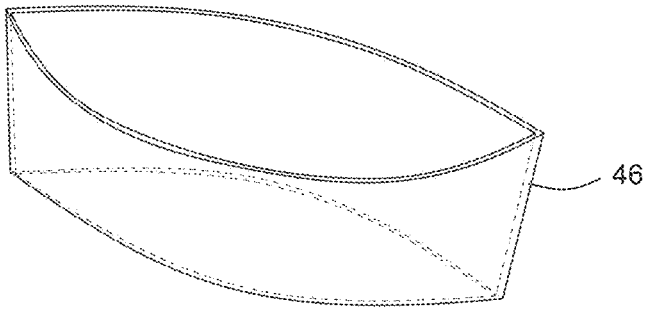

FIG. 23C is a diagonal view of the reinforcement member 46.

Figure 24:
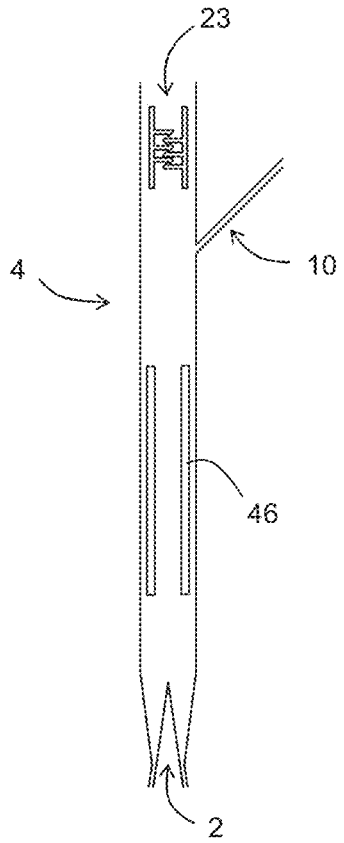

FIG. 24 is a view of the open/close member 23 and the reinforcement member 46 inserted between the front part 3 and the back part 4.

Figure 25:
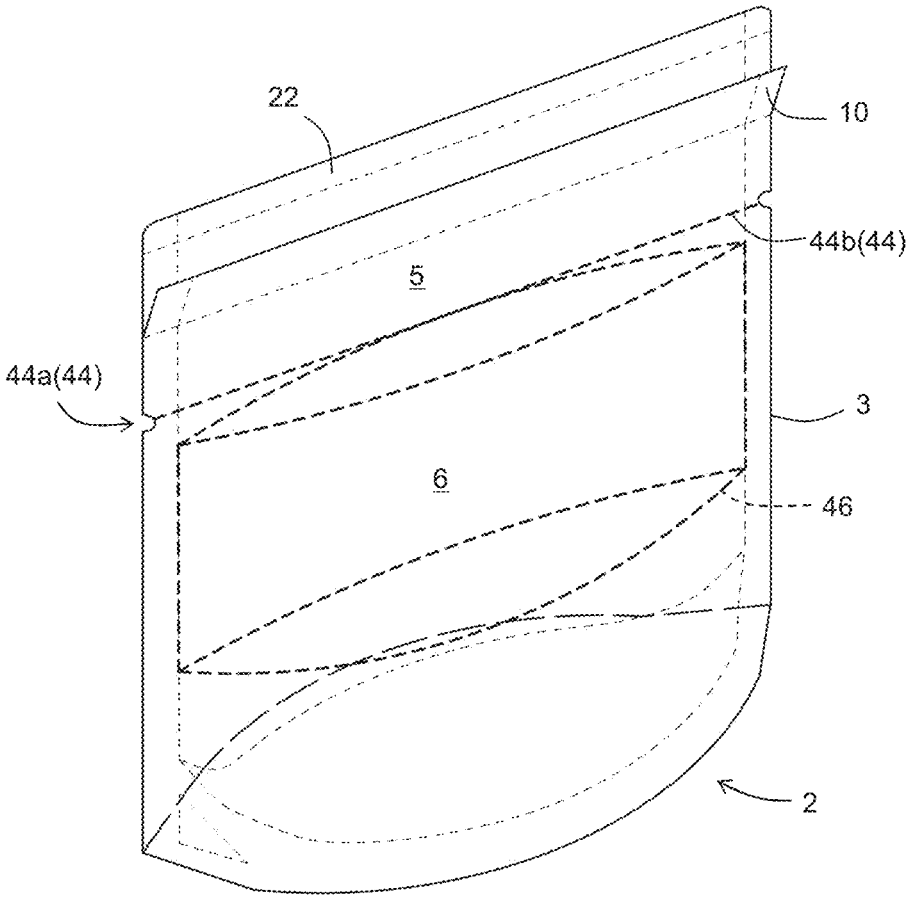

FIG. 25 is a diagram of the packaging bag 1 of the second embodiment.

DETAILED DESCRIPTION

Hereinafter, embodiments of the present invention will be described. Various characteristics in the embodiments described below can be combined with each other. Further, the invention is independently established for each characteristic.

First Viewpoint

1. First Embodiment

1-1. Configuration of Packaging Bag 1

As shown in FIG. 1A to FIG. 3C, a packaging bag 1 in an embodiment of the present invention is a self-standing packaging bag that is made of a flexible film formed into a bag shape and is for use in a microwave oven. The packaging bag 1 includes a bottom surface portion 2 and a peripheral surface portion 21 provided so as to rise from the bottom surface portion 2. The peripheral surface portion 21 includes a front surface portion 3 and a back surface portion 4 facing each other and includes an opening 16 that opens upward. The front surface portion 3 and the back surface portion 4 are welded to each other at their edges in the left-right direction (hereinafter, referred to as side edges). The bottom surface portion 2 is welded (heat-sealed) to the front surface portion 3 and the back surface portion 4. In this way, the bottom surface portion 2, the front surface portion 3, and the back surface portion 4 are welded to each other to form the bag shape.

Figure 2:
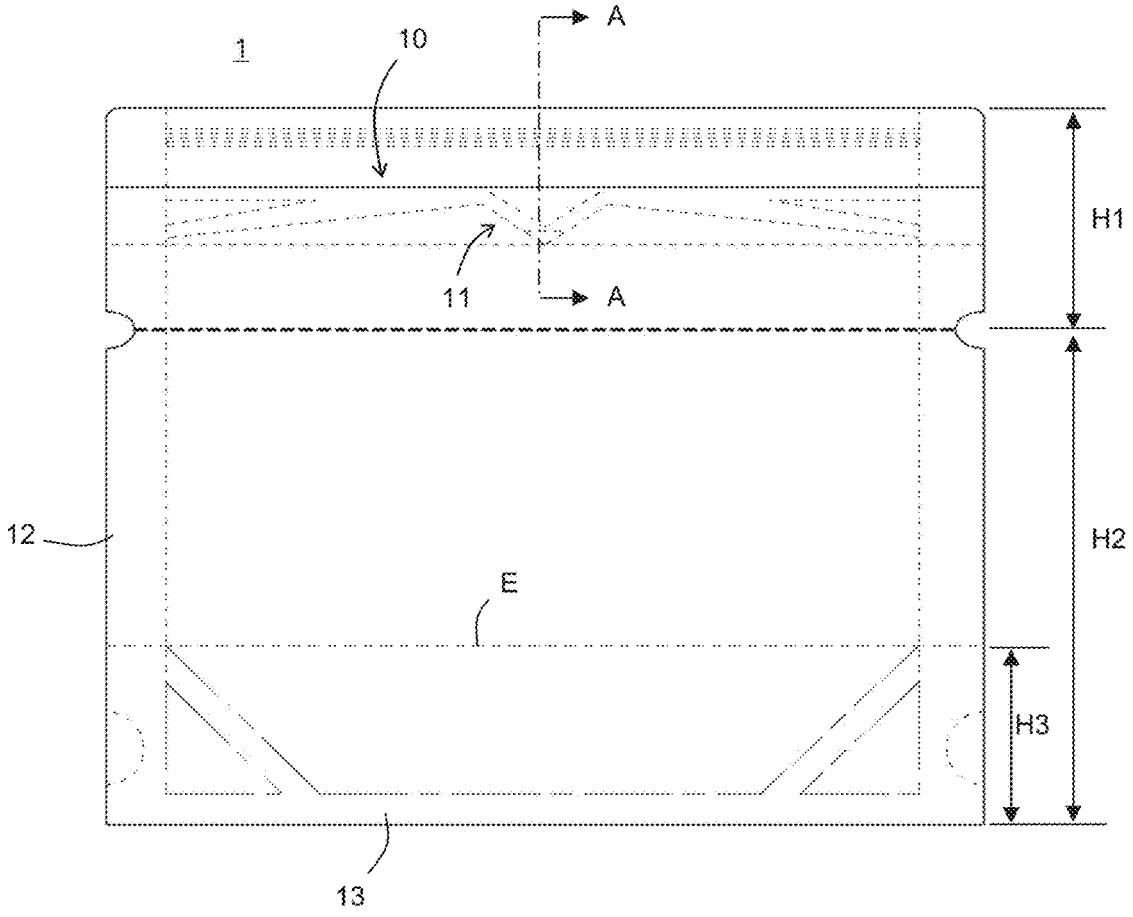
FIG. 2 shows the packaging bag 1 of FIG. 1A in a plan view.
Figure 4:
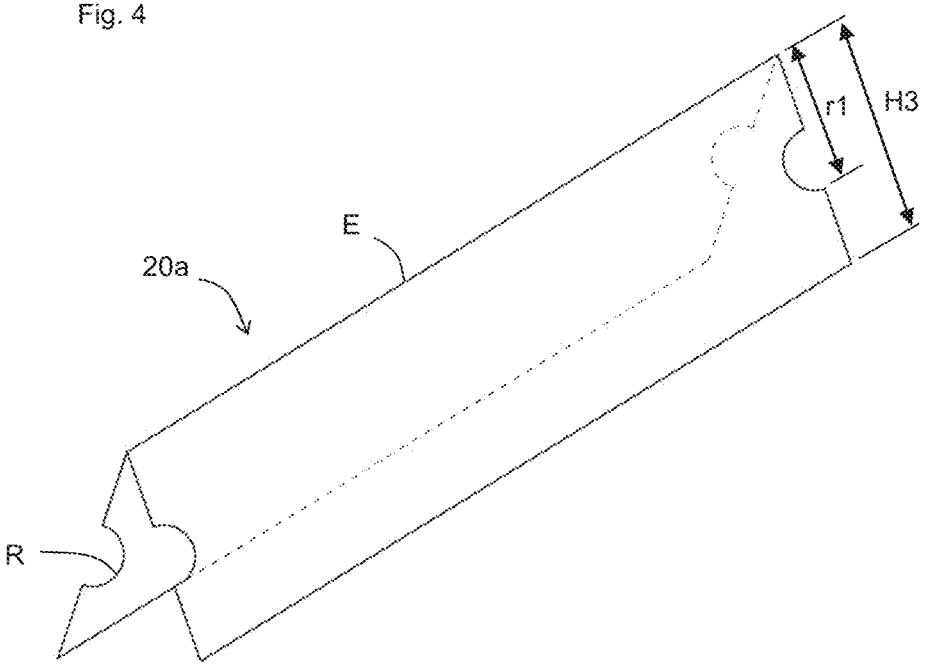
FIG. 4 is a perspective view of a bottom film 20*a* constituting a bottom surface portion 2.

In the present disclosure, the up, down, left, and right sides of FIG. 2 are described as the up, down, left, and right sides of the packaging bag 1. Specifically, a side of the bottom surface portion 2 is the down (lower) side, and a side of the front surface portion 3 (and the back surface portion 4) is the up (upper) side. Further, the left and right sides when the front surface portion 3 is placed in front are the left and right sides of the packaging bag 1. In addition, a side of the front surface portion 3 is the front side, and a side of the back surface portion 4 is the back side.

The front surface portion 3 includes a lower front surface portion 3*a* and an upper front surface portion 3*b*. The lower front surface portion 3*a* is welded to the bottom surface portion 2. As shown in FIG. 3A, the lower front surface portion 3*a* and the upper front surface portion 3*b* are welded to each other at a joint portion 10 formed by overlapping an inner surface of the lower front surface portion 3*a* and an inner surface of the upper front surface portion 3*b* in a state that the lower front surface portion 3*a* and the upper front surface portion 3*b* are both folded back As shown in FIG. 1A to FIG. 3C, the peripheral surface portion 21 of the packaging bag 1 is provided with an openable member 23 and an opening portion 24.

As shown in FIG. 3A to FIG. 3C, the openable member 23 is configured to open and close the opening 16. The openable member 23 includes a front-side engagement member 23*a* and a back-side engagement member 23*b* configured to be able to engage with each other. The front-side engagement member 23*a* is fixed on an inner surface side of the front surface portion 3. The back-side engagement member 23*b* is fixed on an inner surface side of the back surface portion 4. The engagement members 23*a*, 23*b* are preferably fixed by welding to the front surface portion 3 and the back surface portion 4, respectively.

As shown in FIG. 3C, the front-side engagement member 23*a* includes a base portion 23*a*1 and a hook portion 23*a*2 protruding from the base portion 23*a*1. The back-side engagement member 23*b* includes a base portion 23*b*1 and a hook portion 23*b*2 protruding from the base portion 23*b*1. The base portions 23*a*1, 23*b*1 are fixed to the front surface portion 3 and the back surface portion 4, respectively. The hook portions 23*a*2, 23*b*2 can be engaged and disengaged with each other. As shown in FIG. 3B, the opening 16 is closed by engaging the hook portions 23*a*2, 23*b*2 with each other, and as shown in FIG. 3C, the opening 16 is opened by disengaging the hook portions 23*a*2, 23*b*2 with each other.

Although the entire surface of the base portion 23*a*1 may be welded to the front surface portion 3, it is preferable that a lower part of the base portion 23*a*1 is provided with an unwelded portion that is not welded to the front surface portion 3. In this case, when the packaging bag 1 is heated and the internal pressure of the packaging bag 1 rises to inflate the packaging bag 1, the force in the direction of opening the openable member 23 is hardly applied to the openable member 23, and vapor leakage from the openable member 23 can be suppressed. The unwelded portion is preferably provided so as to extend from a lower end of the base portion 23*a*1 to an upper end of the hook portion 23*a*2. In other words, the base portion 23*a*1 is preferably welded to the front surface portion 3 only at a portion above the hook portion 23*a*2. In this regard, the unwelded portion may be provided on the base portion 23*b*1 instead of being provided on the base portion 23*a*1 or may be provided on both of the base portions 23*a*1, 23*b*1.

The opening portion 24 is a portion for opening the packaging bag 1. In the present embodiment, the opening portion 24 includes a tear start portion 24*a* configured to serve as a starting point for tearing the peripheral surface portion 21, and a tear-off line 24*b* where a line indicating a tear-off portion for opening is printed. The packaging bag 1 may be opened by tearing the peripheral surface portion 21 using the tear start portion 24*a* as a starting point or may be opened by cutting the peripheral surface portion 21 along the tear-off line 24*b* using a cutting tool, such as scissors. The tear start portion 24*a* is a portion that facilitates tearing of the peripheral surface portion 21 and includes, for example, a notch or a small cut part. One of the tear start portion 24*a* and the tear-off line 24*b* may be omitted. Further, the opening portion 24 may be configured differently to enable the packaging bag 1 to be opened. For example, instead of the tear-off line 24*b*, a half-cut line extending in the circumferential direction of the peripheral surface portion 21 may be provided, or a strip-shaped film extending in the circumferential direction of the peripheral surface portion 21 may be provided. The strip-shaped film is welded to the peripheral surface portion 21, and the peripheral surface portion 21 can be cut along the strip-shaped film by grasping and pulling the end of the strip-shaped film.

Figure 1A:
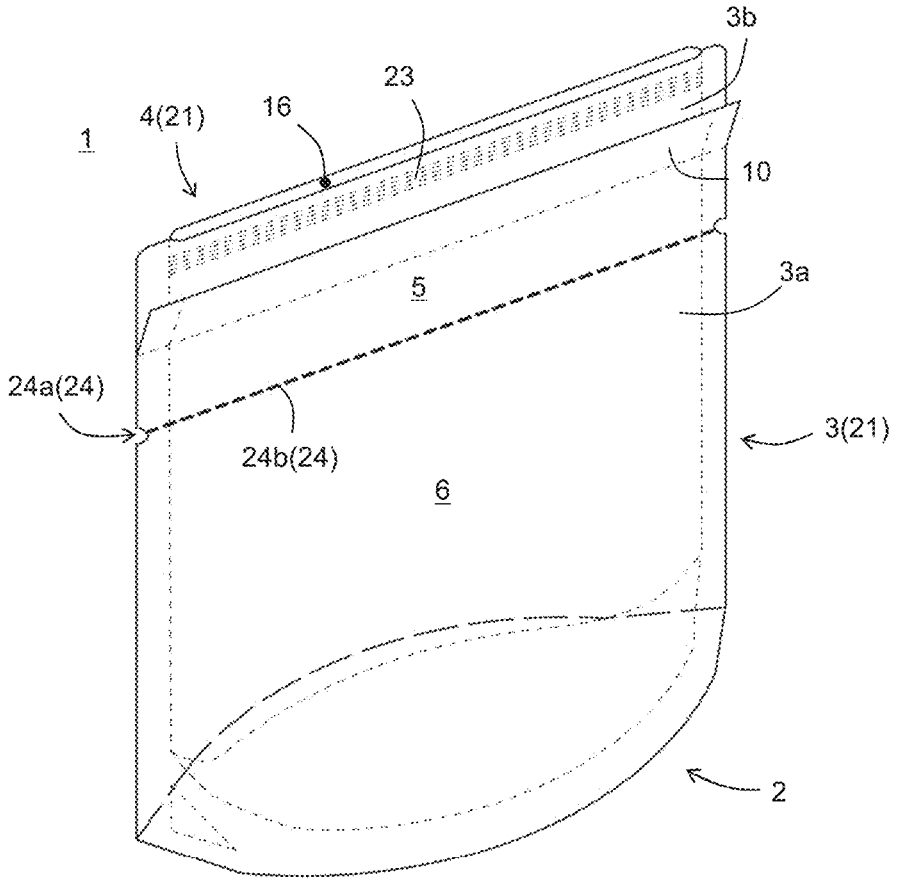
FIG. 1A is a perspective view of a state where contents are accommodated in a packaging bag 1 of a first embodiment of the present invention.
Figure 1B:
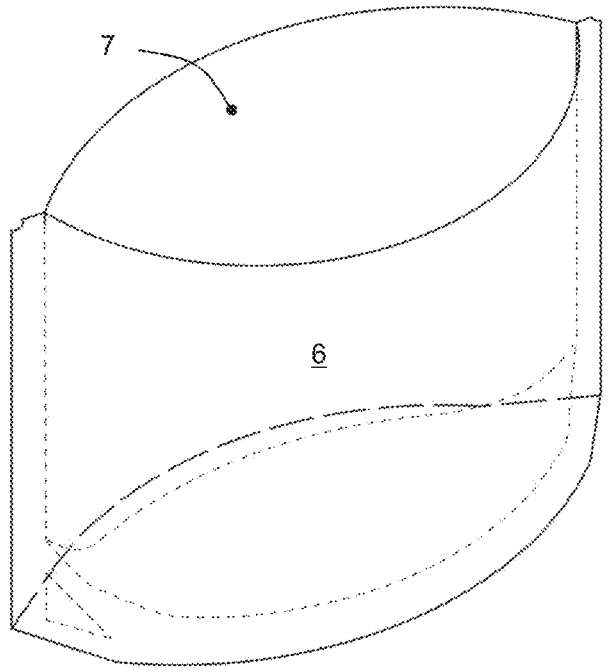
FIG. 1B is a perspective view of the packaging bag 1 in an opened state.

The packaging bag 1 includes a tear-off portion 5 arranged on an upper side and a main body portion 6 arranged on a lower side in the up-down direction with the opening portion 24 as a boundary. A container-shaped main body portion 6 is obtained by tearing the peripheral surface portion 21 in the circumferential direction at the opening portion 24 to remove the tear-off portion 5 above the opening portion 24. As shown in FIG. 1B, an opening 7 is formed in the main body portion 6. The main body portion 6 is used as a dish for eating the contents in the packaging bag 1.

The opening portion 24 is provided closer to the bottom surface portion 2 than the openable member 23. In other words, the openable member 23 is provided in the tear-off portion 5. Therefore, when the tear-off portion 5 is removed for opening, the openable member 23 is also removed together. Thus, the openable member 23 does not interfere with eating the contents.

The opening portion 24 is provided closer to the bottom surface portion 2 than the joint portion 10. In other words, the joint portion 10 is provided in the tear-off portion 5. Therefore, when the tear-off portion 5 is removed for opening, the joint portion 10 is also removed together. Thus, the joint portion 10 does not interfere with eating the contents.

FIG. 2 shows the packaging bag 1 in a plan view. The plan view is a view of the packaging bag 1 that is flattened with no contents contained inside and viewed in such a state from a direction perpendicular to the front surface portion 3 of the packaging bag 1. As shown in FIG. 2, the packaging bag 1 is formed to be line-symmetric with respect to the center line in the left-right direction.

A vapor release seal portion 11 is formed on the packaging bag 1. The vapor release seal portion 11 is provided in the joint portion 10. The vapor release seal portion 11 is a welded portion with lower welding strength than other welded portions. In the vapor release seal portion 11, when the internal pressure in the packaging bag 1 increases due to vapor generated inside by heating the packaging bag 1, a vapor flow path is formed accordingly. The vapor inside the packaging bag 1 is discharged to the outside through the vapor release seal portion 11.

The length H1 of the tear-off portion 5 in the up-down direction is, for example, 6 to 10 cm. The length H2 of the main body portion 6 in the up-down direction is, for example, 6 to 14 cm, preferably equal to or less than 12 cm, and more preferably equal to or less than 10 cm. If the length is too large, it will be difficult to take out the contents. H1 is specifically, for example, 6, 6.5, 7, 7.5, 8, 8.5, 9, 9.5, or 10 cm, and may be in a range between any two of the numerical values exemplified herein. H2 is specifically, for example, 6, 7, 8, 9, 10, 11, 12, 13, or 14 cm, and may be in a range between any two of the numerical values exemplified herein.

Further, the length H2 is preferably longer than the length H3 from a center line E to a lower end of a bottom film 20*a*, and more preferably longer than H3 by 2 cm or more. The value of (H2-H3) is, for example, 2 to 8 cm, specifically, for example, 2, 3, 4, 5, 6, 7, or 8 cm, and may be in a range between any two of the numerical values exemplified herein. If the value of (H2-H3) is less than 2 cm, the height of the peripheral wall when the packaging bag 1 is opened becomes low, and thus the amount of contents may be limited.

The side edges of the packaging bag 1 are provided with a side-edge welded portion 12 for welding the front surface portion 3 and the back surface portion 4. Consequently, the front surface portion 3 and the back surface portion 4 are fixed in the front-back direction. Further, a lower end of the packaging bag 1 is provided with a lower-edge welded portion 13 for welding the bottom surface portion 2 and the front surface portion 3, and the bottom surface portion 2 and the back surface portion 4.

The lower-edge welded portion 13 welds the bottom surface portion 2 to the front surface portion 3 and welds the bottom surface portion 2 to the back surface portion 4 in a region below the center line E and at the side edges and lower end of the packaging bag 1 (in FIG. 2, the region surrounded by the alternate long and short dash line).

As shown in FIG. 4 to FIG. 6B, the packaging bag 1 is manufactured by inserting the bottom film 20*a* that is folded in a V shape at the center line E between the front surface portion 3 and the back surface portion 4. Here, the length H3 from the center line E to the lower end of the bottom film 20*a* is preferably 3 to 6 cm, more specifically, for example, 3, 3.5, 4, 4.5, 5, 5.5, or 6 (unit: cm), and may be in a range between any two of the numerical values exemplified herein, and may be, for example, 4.5 cm. As described above, the main body portion 6 is also used as a dish, and thus it is preferably that the body portion 6 has such a size. A notch R is formed at both ends of the bottom film 20*a*.

The length r1 from the center line E to the lower end of the notch R of the bottom film 20*a* is preferably 1 to 3 cm, more specifically, for example, 1, 1.5, 2, 2.5, or 3 (unit: cm), and may be in a range between any two of the numerical values exemplified herein, and may be, for example, 2.5 cm.

The diameter of the notch R is preferably 1 to 4 cm, more specifically, for example, 1, 1.5, 2, 2.5, 3, 3.5, or 4 (unit: cm), and may be in a range between any two of the numerical values exemplified herein, and may be, for example, 2 cm.

Hereinafter, steps for manufacturing the packaging bag 1 are briefly described with reference to FIG. 5A to FIG. 6B.

Figure 5A:
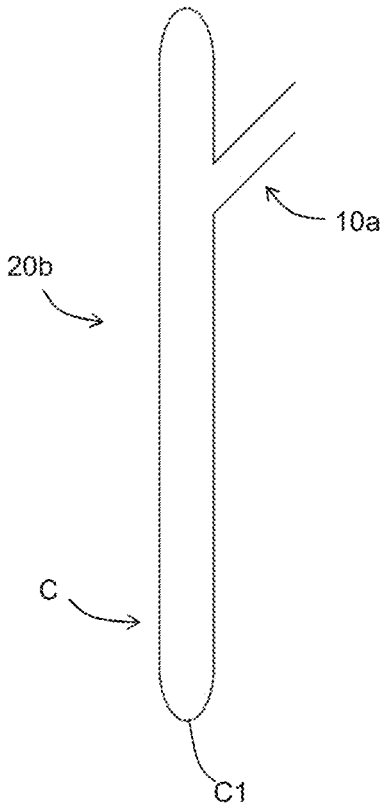
FIG. 5A is a side view of a peripheral wall film 20*b*.
Figure 5B:
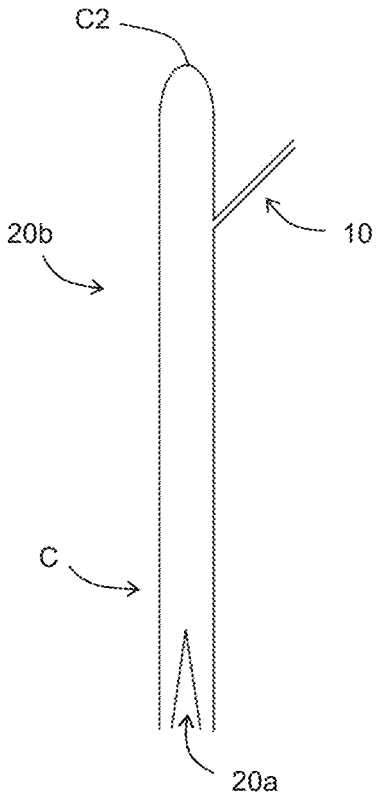
FIG. 5B shows a state where a part of the peripheral wall film 20*b* is cut and the bottom film 20*a* is inserted at the cart part.

First, as shown in FIG. 5A, inner surfaces of end portions of one sheet of peripheral wall film 20*b* are overlapped to form an overlapping portion 10*a*. As shown in FIG. 5B, the joint portion 10 is formed by welding the overlapping portion 10*a*, and the remaining portion forms an elliptical ring C.

Subsequently, as shown in FIG. 5A to FIG. 5B, one end C1 of the ring C is cut, and the bottom film 20*a* folded in a V shape is inserted. Subsequently, as shown in FIG. 5B to FIG. 6A, the bottom film 20*a* and the peripheral wall film

20*b* are welded, and the other end C2 of the ring C is cut, so that the bottom surface portion 2, the front surface portion 3, and the back surface portion 4 are formed.

Figure 6A:
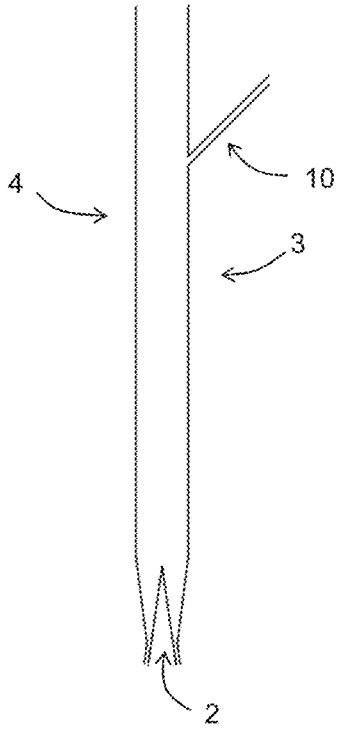
FIG. 6A shows how the peripheral wall film 20*b* and the bottom film 20*a* are welded to manufacture the packaging bag 1.
Figure 6B:
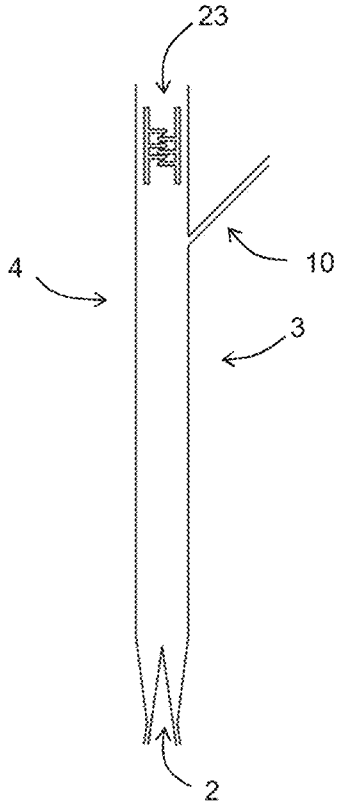
FIG. 6B shows a state where the openable member 23 is inserted between the front surface portion 3 and the back surface portion 4.

Subsequently, as shown in FIG. 6B, in the vicinity of the other end C2 of the ring C (the vicinity of the upper end of the front surface portion 3 and the back surface portion 4), the openable member 23 is inserted between the front surface portion 3 and the back surface portion 4. Then, by welding the openable member 23 to the inner surfaces of the front surface portion 3 and the back surface portion 4, respectively, the packaging bag 1 is manufactured.

Here, the bottom film 20*a* and the peripheral wall film 20*b* are preferably laminated films including a base material layer and a sealant layer, and the laminated films preferably includes an adhesive layer and a printing layer between the base material layer and the sealant layer.

The base material layer is arranged so as to be exposed on the outer surface of the packaging bag 1, and the sealant layer is arranged so as to be exposed on the inner surface of the packaging bag 1. The welded portion is formed by welding (heat-sealing) the sealant layers to each other.

The base material layer is formed of a material having excellent strength and high impact resistance. As the base material layer, for example, polyamide, polyolefin, polyethylene, polyester, and the like are used. More specifically, oriented polyethylene terephthalate film, silica-deposited oriented polyethylene terephthalate film, alumina-deposited oriented polyethylene terephthalate film, oriented nylon film, oriented polypropylene film, polypropylene/ethylene-vinyl alcohol copolymer co-extruded co-oriented film, or the like can be used. As a film forming the base material layer, a film having straight line cuttability in the MD direction (the direction in which the film flows during manufacturing) is preferably used. The base material layer, which is the outermost layer, may contain antibacterial or antiviral agent, such as silver ions. In particular, by kneading a bleed-out antibacterial or antiviral agent into the base material layer, the antibacterial or antiviral treatment progresses on the surface of the base material layer when it is heated to a high temperature in a microwave oven, which is hygienic and preferable when removing from the microwave oven.

The adhesive layer is a layer for allowing the base material layer and the sealant layer to adhere to each other so as to be laminated. The adhesion method may be extrusion lamination using, for example, polyethylene as the adhesive layer, or may be dry lamination using polyvinyl acetate adhesive, polyacrylate adhesive, cyanoacrylate adhesive, ethylene copolymer adhesive, cellulose adhesive, polyester adhesive, polyamide adhesive, amino resin adhesive, epoxy adhesive, polyurethane adhesive, and the like as adhesive material.

The sealant layer can be formed of resin with excellent weldability. The sealant layer can be formed with polyolefin-based resins, such as polyethylene, polypropylene, ethylene-vinyl acetate copolymer, and ethylene-propylene block copolymer. More specifically, non-oriented polypropylene and linear low-density polyethylene can be used. As a film forming the sealant layer, a film having straight line cuttability in the MD direction is preferably used.

The sealant layer, which is the innermost surface of the packaging bag 1, may be subjected to an easy-slipping treatment. The easy-slipping treatment is a treatment for enhancing slipping property, and can be performed by mixing or applying a lubricant to the sealant layer or by applying a water repellent or oil repellent treatment to the innermost surface of the packaging bag 1. Consequently, the slipping property of the contents adhering to the inner surface of the packaging bag 1 is improved. The easy-slipping treatment is preferably performed in the vicinity of the opening portion 24 and in the tear-off portion 5. When the packaging bag 1 is heated with the packaging bag 1 laid down, the contents may move to the opening portion 24 and the tear-off portion 5, and hands or scissors may get dirty in such a case when the packaging bag 1 is opened. In the packaging bag 1 subjected to the easy-slipping treatment, the contents fall to the bottom when the packaging bag 1 is set upright, so that hands and scissors are prevented from getting dirty when the packaging bag 1 is opened. The easy-slipping treatment may be performed during film production or during bag manufacturing.

As an example, in the present embodiment, the film has a structure including the base material layer: oriented nylon (25 μm)/printing layer/adhesive layer (dry laminate)/sealant layer: LLDPE (60 μm). In this regard, an intermediate layer may be provided between the base material layer and the sealant layer. As the intermediate layer, a film made of polyethylene terephthalate, polyamide, polyolefin, such as polyethylene and polypropylene, polyvinyl chloride, polycarbonate, polyvinyl alcohol, ethylene-propylene copolymer, ethylene-vinyl acetate copolymer saponified products, a film obtained by coating the film made of these materials with polyvinylidene chloride, a film obtained by vapor deposition of inorganic substance, such as silicon oxide and aluminum oxide, or a film made of polyvinylidene chloride or the like can be used.

Figure 7A:
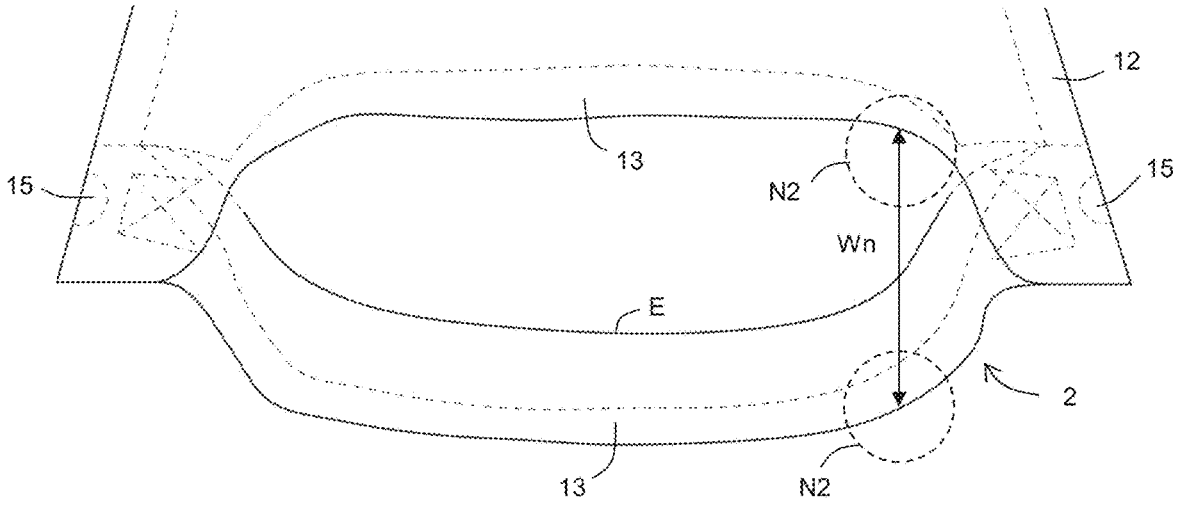
FIG. 7A is an enlarged view of the bottom surface portion 2 in a state where a center lower end of the packaging bag 1 is widely opened in a front-back direction.

As shown in FIG. 7A, the packaging bag 1 is configured to open wider in the front-back direction at a lower end of the center portion in the left-right direction (hereinafter, referred to as the center lower end) than at a lower end of the side portions in the left-right direction (hereinafter, referred to as the side lower ends). This is because the front surface portion 3 and the back surface portion 4 are directly welded to each other at the notch R (see FIG. 4) formed on the bottom film 20*a*, and a fixed portion 15 is configured to fix the front surface portion 3 and the back surface portion 4 in the front-back direction. In this regard, by opening the center lower end in the front-back direction, the center line E of the bottom surface portion 2 is pulled downward of the packaging bag 1.

Figure 7B:
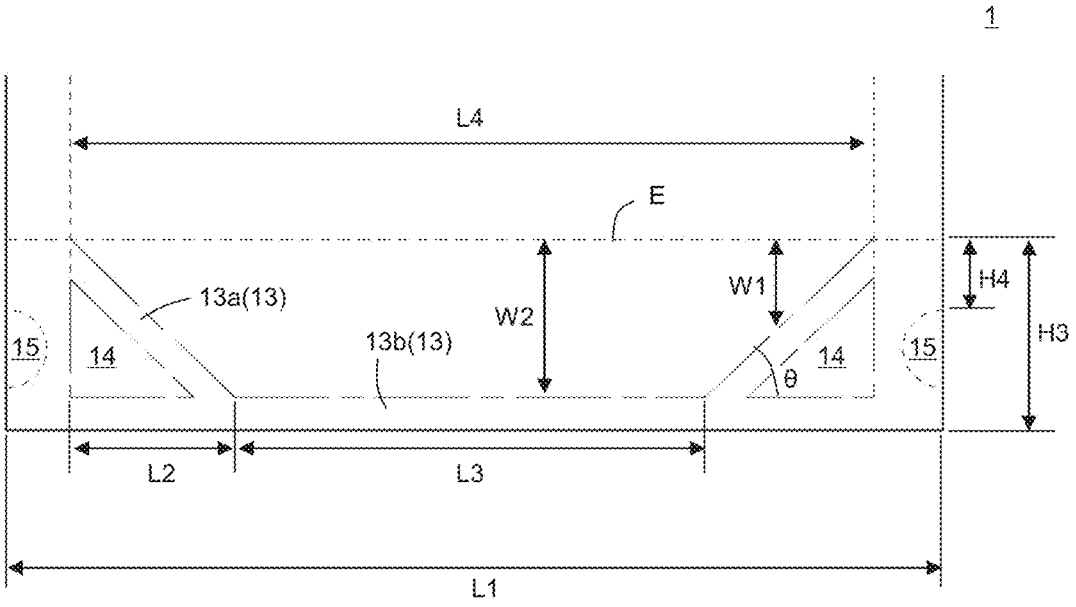
FIG. 7B is a detailed view of the vicinity of the lower end of the packaging bag 1 of FIG. 2.

As shown in FIG. 7B, the lower-edge welded portion 13 includes a pair of gradient portions 13*a* and a center portion 13*b*. The gradient portion 13*a* is a portion that is welded at a gradient (diagonally) from the side edge of the packaging bag 1 to the center lower end. By providing the gradient portion 13*a* in such a way, the distance from the center line E to the lower-edge welded portion 13 gradually increases (W1<W2) from the side edge to the center portion in the left-right direction. This configuration prevents pinhole from occurring at the side lower end.

The center portion 13*b* is provided between a pair of gradient portions 13*a* and is formed in a straight line. By providing the center portion 13*b* in a straight line, the main body portion 6 can be easily used as a dish.

An air pocket 14 is provided on the outer side of the gradient portion 13*a*. The air pocket 14 is formed in a triangular shape and is a space where air that has not been discharged to the outside during welding at the lower-edge welded portion 13 remains. By providing the air pocket 14, residual air in the lower-edge welded portion 13 is collected in the air pocket 14, thereby improving welding strength.

The length L1 in the left-right direction at the lower end of the packaging bag 1 is preferably 15 to 25 cm and more preferably equal to or more than 18 cm. The length L1 is more specifically, for example, 15, 16, 17, 18, 19, 20, 21, 22, 23, 24, or 25 (unit: cm) and may be in a range between any two of the numerical values exemplified herein, and may be, for example, 20 cm. If the length L1 is more than 25 cm, the packaging bag 1 may not fit in a turntable of a microwave oven. However, this does not apply to a packaging bag for use in a microwave oven with a flat table.

The length L2 of the gradient portion 13*a* in the left-right direction is preferably 3 to 6 cm, more specifically, for example, 3, 3.5, 4, 4.5, 5, 5.5, or 6 (unit: cm), and may be in a range between any two of the numerical values exemplified herein, and may be, for example, 4 cm. If the length L2 is too small, it will be difficult to fully open the center lower end in the front-back direction.

The length L3 of the center portion 13*b* in the left-right direction is preferably 5 to 15 cm and more preferably equal to or more than 8 cm. More specifically, the length L3 is, for example, 5, 6, 7, 8, 9, 10, 11, 12, 13, 14, or 15 (unit: cm) and may be in a range between any two of the numerical values exemplified herein, and may be, for example, 10 cm. By setting the value of L3 in this way, when the bottom surface portion 2 is extended in the front-back direction, the distance between the front surface portion 3 and the back surface portion 4 in the front-back direction can be increased, thereby increasing the size of the opening 7.

The length L4 inside the packaging bag 1 in the left-right direction is preferably 10 to 23 cm and more specifically, for example, 10, 11, 12, 13, 14, 15, 16, 17, 18, 19, 20, 21, 22, or 23 (unit: cm). Further, the length L4 may be in a range between any two of the numerical values exemplified herein and may be, for example, 18 cm.

The length W2 from the center line E to the upper end of the center portion 13*b* is preferably 3 to 6 cm and more specifically, for example, 3, 3.5, 4, 4.5, 5, 5.5, or 6 (unit: cm). Further, the length W2 may be in a range between any two of the numerical values exemplified herein and may be, for example, 4 cm. In this regard, the length W2 is more preferably the same length as the length L2 of the gradient portion 13*a* in the left-right direction.

In this regard, the ratio of the length L3 of the center portion 13*b* in the left-right direction to the length W2 from the center line E to the upper end of the center portion 13*b* preferably satisfies the condition of $2 \leq L3/W2 \leq 3$. Preferably, the value of L3/W2 is more specifically, for example, 2.0, 2.2, 2.4, 2.6, 2.8, or 3.0 and may be in a range between any two of the numerical values exemplified herein. In such a configuration, when the bottom surface portion 2 is extended in the front-back direction, a larger bottom surface in contact with the mounting surface can be provided.

Further, the ratio of the length W2 from the center line E to the upper end of the center portion 13*b* to the length L2 of the gradient portion 13*a* in the left-right direction preferably satisfies the condition of $0.5 \leq W2/L2 \leq 1.7$. Preferably, the value of W2/L2 is more specifically, for example, 0.5, 0.6, 0.7, 0.8, 0.9, 1.0, 1.1, 1.2, 1.3, 1.4, 1.5, 1.6, or 1.7 and may be in a range between any two of the numerical values exemplified herein. More preferably, the value of W2/L2 satisfies the condition of $0.8 \leq W2/L2 \leq 1.2$, even more preferably $0.9 \leq W2/L2 \leq 1.1$. When W2/L2 is too small, the front surface portion 3 and the back surface portion 4 tend to become closer to each other at the opening 7 when the packaging bag 1 is opened, which reduces convenience when using it as a dish. On the other hand, when W2/L2 is too large, a crease is generated on the inner side of the gradient portion 13*a* when the bottom surface portion 2 is extended in the front-back direction, which will interfere with removal of the contents.

The ratio of the height H4 from the center line E to the upper end of the fixed portion 15 to the length H3 from the center line E to the lower end preferably satisfies the condition of $H4/H3 \geq 0.2$. Preferably, the value of H4/H3 satisfies the condition of $0.5 \geq H4/H3 \geq 0.2$, and is more specifically, for example, 0.20, 0.25, 0.30, 0.35, 0.40, 0.45, or 0.50 and may be in a range between any two of the numerical values exemplified herein. By setting the height H4 from the center line E to the fixed portion 15 in this way, the opening 7 can be reliably kept open in the front-back direction.

The value of the angle θ of the gradient portion 13*a* relative to the upper end of the center portion 13*b* is preferably 30 to 60 degrees, and more specifically, for example, 30, 35, 40, 45, 50, 55, or 60 (unit: degrees). The angle θ may be in a range between any two of the numerical values exemplified herein, and more preferably 45 degrees. By setting the angle θ of the gradient portion 13*a* larger than 30 degrees, the width Wn in the front-back direction between vicinity regions N2 in the vicinity of the side edges of the packaging bag 1 can be secured, and the bottom surface of the packaging bag 1 can be larger, thereby improving the self-standing stability of the packaging bag 1 (see FIG. 7A). In addition, the opening portion 24 can be opened wide in the front-back direction, and thus the convenience of using the packaging bag as a dish is improved.

In this regard, the bottom film 20*a* is preferably a film whose tensile modulus decreases with increasing temperature. In this case, when the packaging bag 1 is heated, the film softens, and the center lower end of the packaging bag 1 can be easily opened in the front-back direction. Here, M1 and M2 represent tensile modulus of the film forming the bottom surface portion 2 in the TD direction (corresponding to the front-back direction of the packaging bag 1) at 23.5° C. and 100° C., respectively. The tensile modulus can be obtained by conducting a tensile test in accordance with JIS K 7127. The test speed in the tensile test is set at 50 mm/min, and the dumbbell shape for the test is No. 5.

M1 is preferably 600 to 1400 MPa and more preferably 800 to 1200 MPa. M1 is specifically, for example, 600, 700, 800, 900, 1000, 1100, 1200, 1300, or 1400 MPa, and may be in a range between any two of the numerical values exemplified herein.

M2 is preferably 200 to 600 MPa and more preferably 300 to 500 MPa. M2 is specifically, for example, 200, 250, 300, 350, 400, 450, 500, 550, or 600 MPa, and may be in a range between any two of the numerical values exemplified herein.

The value of M1/M2 is, for example, 1.2 to 4 and preferably 1.5 to 3. This value is specifically, for example, 1.2, 1.5, 2, 2.5, 3, 3.5, or 4, and may be in a range between any two of the numerical values exemplified herein.

As the peripheral wall film 20*b*, a film with the same physical properties as the bottom film 20*a* may be used, or a film with different physical properties from the bottom film 20*a* may be used.

2. Second Embodiment

The second embodiment of the present invention will be described with reference to FIG. 8A and FIG. 8B. The present embodiment is similar to the first embodiment, and the main difference is in the structure in the vicinity of the opening 16 of the packaging bag 1. Hereinafter, the description will focus on the difference.

Figure 8A:
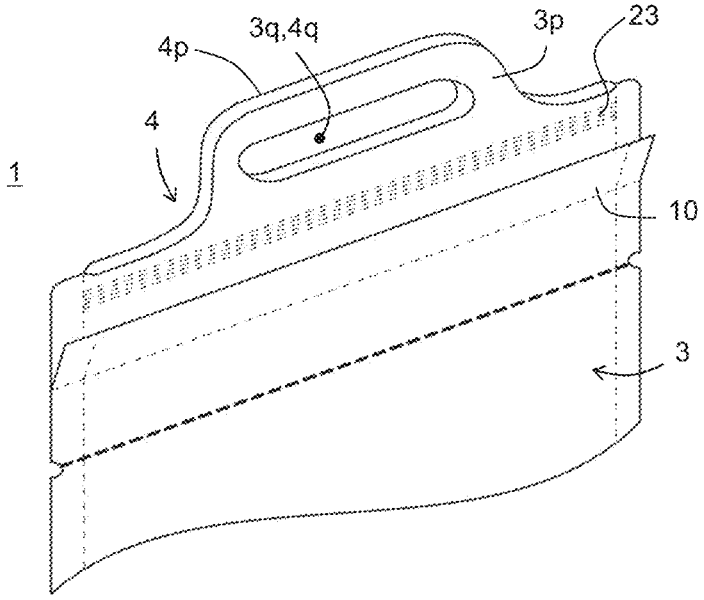
FIG. 8A is a perspective view of the packaging bag 1 of a second embodiment of the present invention.
Figure 8B:
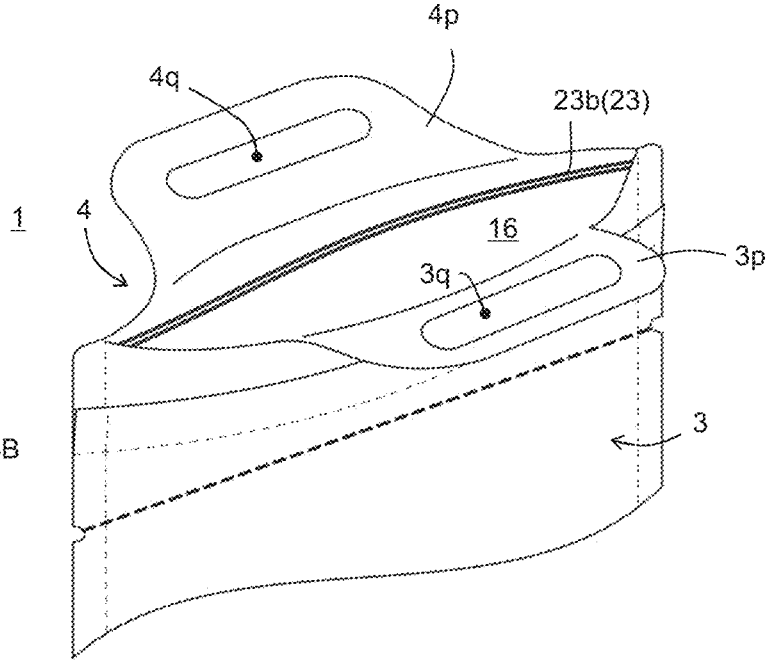
FIG. 8B shows a state where an opening 16 of the packaging bag 1 in FIG. 8A is opened.

In the present embodiment, as shown in FIG. 8A, the upper end of the front surface portion 3 is provided with a first protruding portion 3*p* that protrudes upward, and the upper end of the back surface portion 4 is provided with a second protruding portion 4*p* that protrudes upward. When the packaging bag 1 is filled with the contents, the opening 16 can be easily maintained in a widened state by spreading the protruding portions 3*p*, 4*p* outward, as shown in FIG. 8B, and thus the packaging bag 1 can be easily filled with the contents. Further, the protruding portions 3*p*, 4*p* can be provided with openings 3*q*, 4*q* that constitute handles. After filling the packaging bag 1 with the contents, the packaging bag 1 can be easily carried by placing fingers in the openings 3*q*, 4*q* and holding the packaging bag 1.

3. Third Embodiment

Figure 9:
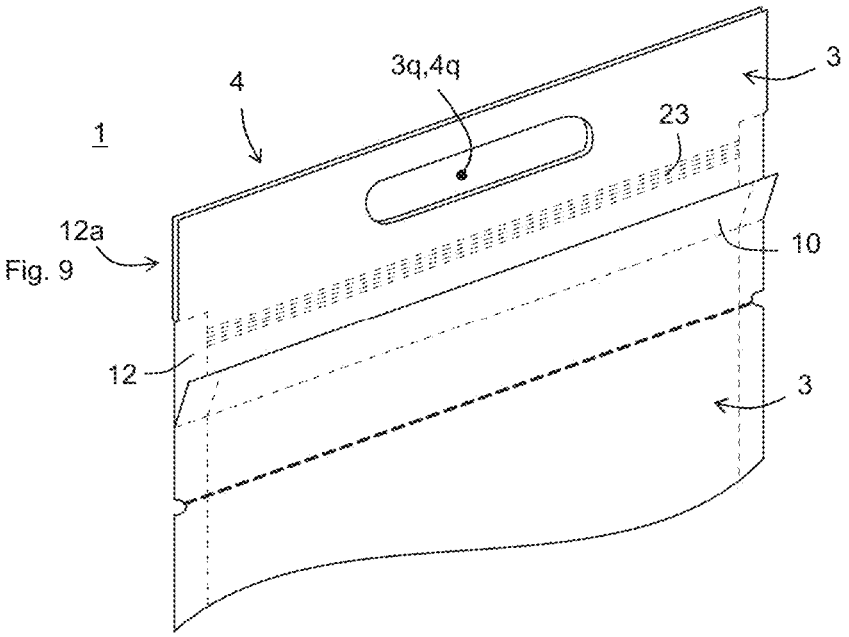
FIG. 9 is a perspective view of the packaging bag 1 of a third embodiment of the present invention.

The third embodiment of the present invention will be described with reference to FIG. 9. The present embodiment is similar to the first embodiment, and the main difference is in the structure in the vicinity of the opening 16 of the packaging bag 1. Hereinafter, the description will focus on the difference.

In the first embodiment, the front surface portion 3 and the back surface portion 4 are welded to each other up to the upper end of the packaging bag 1 at the side-edge welded portions 12. On the other hand, in the present embodiment, as shown in FIG. 9, the distance from the openable member 23 to the upper end of the packaging bag 1 is longer than in the first embodiment, and an unwelded portion 12*a* where the front surface portion 3 and the back surface portion 4 are not welded to each other is provided in the vicinity of the upper end of the packaging bag 1. Consequently, when the packaging bag 1 is filled with the contents, the opening 16 of the packaging bag 1 can be easily maintained in a widened state by folding back the front surface portion 3 and the back surface portion 4 at the unwelded portion 12*a*.

The configuration of the present embodiment is preferable because man hours required for processing the front surface portion 3 and the back surface portion 4 are less than those required in the second embodiment.

Further, in a region between the openable member 23 and the upper end of the packaging bag 1, the front surface portion 3 and the back surface portion 4 may be provided with the openings 3*q*, 4*q* that constitute handles. Consequently, after filling the packaging bag 1 with the contents, the packaging bag 1 can be easily carried by placing fingers in the openings 3*q*, 4*q* and holding the packaging bag 1.

4. Fourth Embodiment

The fourth embodiment of the present invention will be described with reference to FIG. 10A and FIG. 10B. The present embodiment is similar to the first embodiment, and the main difference is in the structure in the vicinity of the opening 16 of the packaging bag 1. Hereinafter, the description will focus on the difference.

Figure 10A:
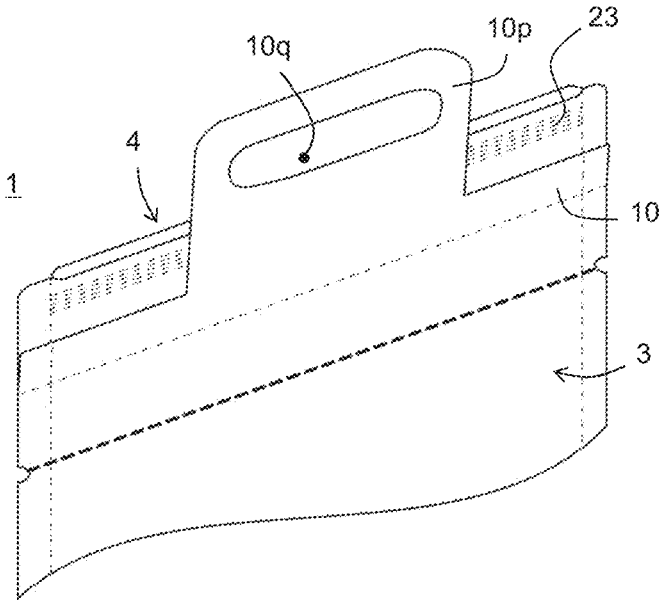
FIG. 10A is a perspective view of the packaging bag 1 of a fourth embodiment of the present invention.
Figure 10B:
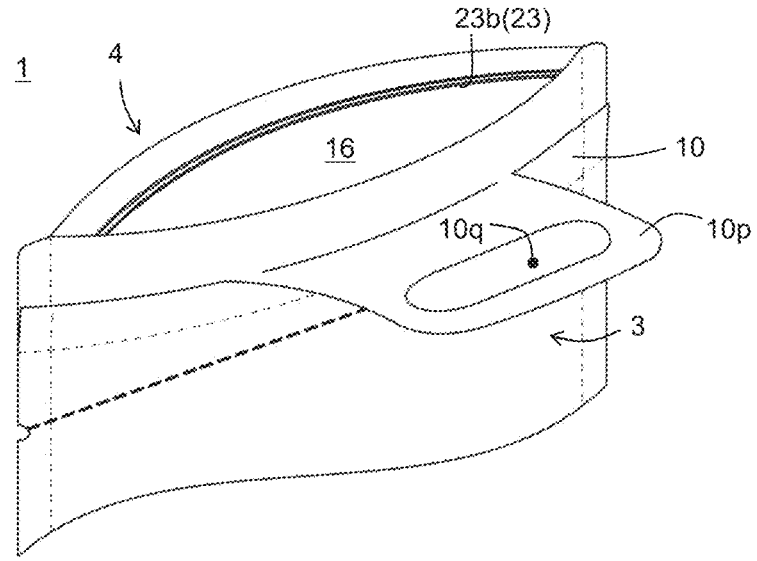
FIG. 10B shows a state where the opening 16 of the packaging bag 1 of FIG. 10A is opened.

In the present embodiment, as shown in FIG. 10A, the joint portion 10 is provided with a protruding portion 10*p* that protrudes from the upper end of the front surface portion 3 in a state where the joint portion 10 is inclined toward an upper end side of the front surface portion 3. When the packaging bag 1 is filled with the contents, the opening 16 can be easily maintained in a widened state by spreading the protruding portion 10*p* outward, as shown in FIG. 10B, and thus the packaging bag 1 can be easily filled with the contents. Further, the protruding portion 10*p* can be provided with an opening 10*q* that constitutes a handle. Consequently, after filling the packaging bag 1 with the contents, the packaging bag 1 can be easily carried by placing fingers in the opening 10*q* and holding the packaging bag 1.

5. Fifth Embodiment

Figure 11:
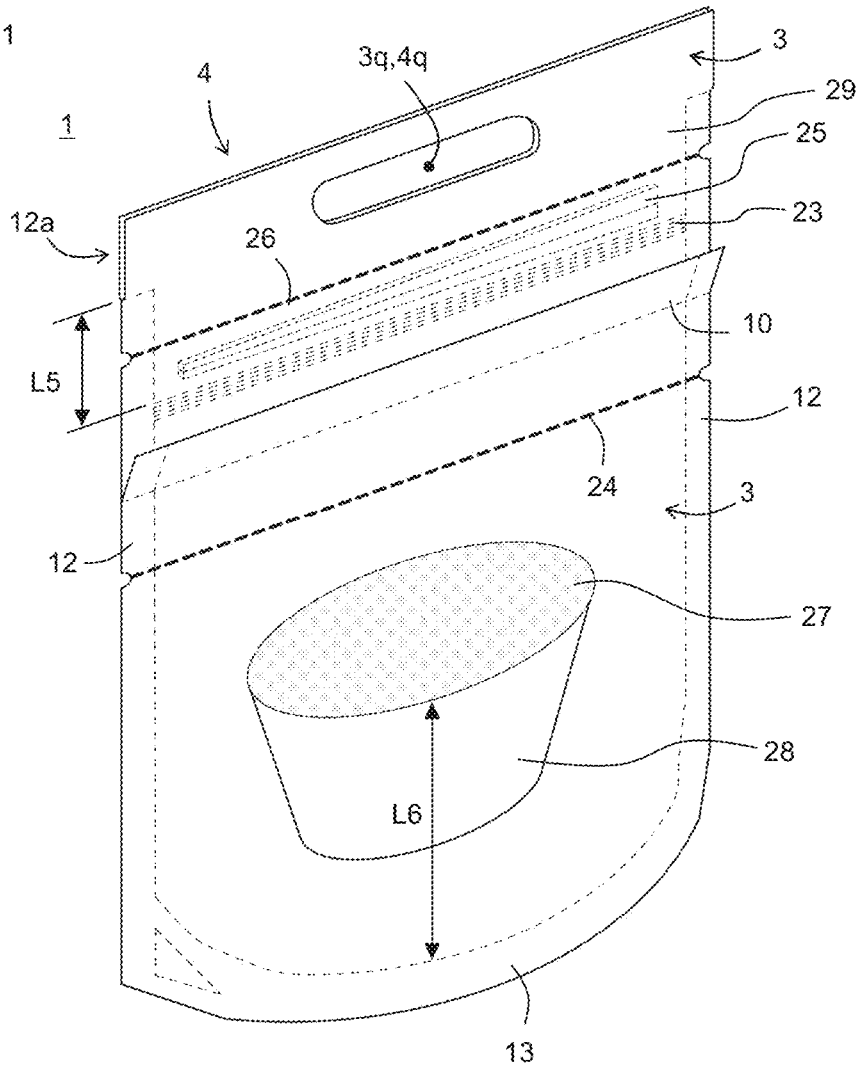
FIG. 11 is a perspective view of the packaging bag 1 of a fifth embodiment of the present invention.

The fifth embodiment of the present invention will be described with reference to FIG. 11. The present embodiment is similar to the third embodiment. Hereinafter, the description will focus on the difference.

In the present embodiment, the length L5 from the upper end of the openable member 23 to the upper end of the side-edge welded portion 12 is larger than in the third embodiment. The length L5 is, for example, 1 to 8 cm and preferably 2 to 6 cm. The length L5 is specifically, for example, 1, 2, 3, 4, 5, 6, 7, or 8 cm, and may be in a range between any two of the numerical values exemplified herein. The upper end of the side-edge welded portion 12 is approximately at the same height as the openings 3*q*, 4*q*.

Since the length L5 is large, a container-shaped tool accommodation portion 29 is formed in a region surrounded by the openable member 23 and a pair of side-edge welded portions 12. The tool accommodation portion 29 can accommodate a tool (chopsticks, spoons, forks, and the like) 25 used when eating the contents in the packaging bag 1. In FIG. 11, the tool 25 is relatively short, and the entire tool 25 is accommodated in the tool accommodation portion 29. When the tool 25 is too long to be entirely accommodated in the tool accommodation portion 29, a part of the tool 25 may be accommodated in the tool accommodation portion 29.

An opening portion 26 may be provided at a position above the openable member 23. The configuration of the opening portion 26 is similar to the configuration of the opening portion 24. Since the overall height of the packaging bag 1 of the present embodiment is large, it may interfere with the inner top surface of a household microwave oven if it is placed in the microwave oven as it is. Therefore, before heating the contents in the packaging bag 1 with the microwave oven, it is preferable to tear the packaging bag 1 at the opening portion 26 and remove the portion above the opening portion 26. The opening portion 26 is preferably provided at a portion where the side-edge welded portion 12 is present. In this case, the packaging bag 1 can be easily torn. Further, the opening portion 26 is preferably arranged at a position adjacent to the openable member 23. In this case, the overall height of the packaging bag 1 after removing the portion above the opening portion 26 can be reduced. Similarly to the first embodiment and the like, after heating the contents in the microwave oven, the packaging bag 1 is opened at the opening portion 24, and the portion below the opening portion 24 is usable as a dish when eating the contents in the packaging bag 1.

The front surface portion 3 is provided with a transparent portion 27, and the contents can be visually recognized through the transparent portion 27. The transparent portion 27 is provided at a position corresponding to the upper surface of a drawing pattern 28 of a dish, so that it looks as if the contents are served on the dish, which can stimulate the appetite of consumers. Further, the region between the transparent portion 27 and the lower-edge welded portion 13 is preferably opaque. When the contents contain soup, the soup tends to accumulate at the bottom of the packaging bag 1, and the appearance of the accumulated soup is not good. Therefore, by making the region between the transparent portion 27 and the lower-edge welded portion 13 opaque, it becomes difficult to visually recognize the accumulated soup, and the appearance is improved. The length L6 from the upper end of the lower-edge welded portion 13 to the lower end of the transparent portion 27 is, for example, 1 to 15 cm, preferably 2 to 10 cm, specifically, for example, 1, 2, 3, 4, 5, 6, 7, 8, 9, 10, 11, 12, 13, 14, or 15 cm, and may be in a range between any two of the numerical values exemplified herein.

6. Other Embodiments

While the embodiments have been described above, the technical ideas in the present disclosure can be also adopted in the following aspects.

- The peripheral surface portion 21 may include a pair of side surface portions between the front surface portion 3 and the back surface portion 4. In this case, the front surface portion 3 and the back surface portion 4 are each welded to the pair of side surface portions to form the peripheral surface portion 21 of the substantially rectangular cylindrical shape.
- Although the fixed portion 15 is configured by the semicircular notch R formed on the bottom surface portion 2 in the above-described embodiments, the configuration is not limited to this example. For example, the facing surfaces of the bottom film may be adhered to each other using an adhesive agent, or the front surface portion 3 and the back surface portion 4 may be fixed in the front-back direction by a locking means, such as a stapler.
- Although the bottom surface portion 2 is formed of a film folded in a V shape in the above-described embodiments, the configuration is not limited to this example. For example, it may be formed of a film folded in a W shape.
- The packaging bag 1 may not include the vapor release seal portion 11. In such a case, the vapor generated during heating can be discharged, for example, by slightly opening the bag
- The packaging bag 1 may not include the joint portion 10.
- The vapor release seal portion 11 may be provided in a portion other than the joint portion 10.
- The manufacturing method of the packaging bag 1 is not limited to the method described in the above embodiments.
- The opening serving as the handle may be formed by punching out the film, or may be formed by forming a C-shaped notch on the film.

Second Viewpoint

1. First Embodiment 1-1. Configuration Of Packaging Bag 1

The packaging bag 1 of this viewpoint is similar to the packaging bag 1 of the first viewpoint, and the description in the first viewpoint applies to the packaging bag 1 of this viewpoint as long as it does not contradict the purpose. The basic configuration of the packaging bag 1 of this viewpoint is similar to that of the packaging bag 1 of the first viewpoint, but the packaging bag 1 of this viewpoint does not require the opening/closing member 23. The following explanation focuses on the differences.

As shown in FIG. 12, a tool 25 is attached to the bottom portion 2 of the packaging bag 1 in the embodiment of the invention for use by the user when eating the contents in the packaging bag 1. Details of the tool 25 are described below.

FIG. 13 shows the packaging bag 1 in plan view. Flat view means that the packaging bag 1 is flattened with no contents contained in the packaging bag 1 and no tools 25 attached, and is viewed from a direction perpendicular to the front portion 3 of the packaging bag 1 in that state. As shown in FIG. 12*a*, when the contents are contained in the packaging bag 1, the top end of the packaging bag 1 has a top end welding portion 22 that welds the front portion 3 to the back portion 4.

Referring to FIGS. 14*a* and 14*b*, the tool 25 is described in detail. As shown in FIG. 14A, the tool 25 is attached to the bottom portion 2 using an affixing seal 36. The material of the affixing seal 36 is not limited, but from the viewpoint of visibility of the tool 25, a transparent film material such as polyester film is preferred over paper material.

As an example, the tool 25 can be a split-tip spoon as shown in FIG. 14*b*, but it is not limited to this form and can be a (regular) spoon, fork, chopsticks, etc. The tool 25 is preferably made of paper, and is flat when attached to the bottom section 2, and can be folded to form a three-dimensional shape after removal. As shown in FIG. 14*c*, the thickness T of the tool 25 should be between 5 mm and 15 mm. The thickness T may specifically be, for example, 5, 7, 9, 11, 13, or 15 mm, and may range between any two of the values illustrated here. In this way, it is possible to prevent the packaging bag 1 from becoming bulky before containing the contents, which are attached to the bottom portion 2 with the affixing seal 36.

The bottom welded portions 13 of the front portion 3 and the back portion 4 may be heat-sealed to each other. In this case, the tool 25 may be attached to the bottom portion 2 in the form of being accommodated in the space formed between the front portion 3 and the back portion 4. Here, the tools 25 can be easily removed by partially heating the bottom welded portions 13 of the front portion 3 and the back portion 4 to each other. If the tools 25 are housed in the space formed by sheet-sealing the bottom end welded portions 13 of the front portion 3 and the back portion 4, the seal is opened after heating, and the tools 25 can be taken out.

2. Second Embodiment

FIG. 15 is used to describe the second embodiment of the invention. In this embodiment, the packaging bag 1 differs from the above embodiment in that the packaging bag 1 has a tool housing space 37, which is a space for storing 25 tools, at the end in the left-right direction. The following description will focus on the differences.

In this embodiment, as shown in FIG. 15, a tool storage space 37 for storing 25 tools is provided on the side of the content storage space 38 for storing contents. The contents housing space 38 and the tool housing space 37 are separated by a partition weldment 39 that is heat-sealed in the vertical direction.

The user can remove the tools 25 from the tool housing space 37 by tearing the peripheral portion 21 from the opening 24 and separating the cut-out portion 5 and the body portion 6. In this case, to prevent the tools 25 from being heated, only the tool housing space 37 may be opened and the tools 25 removed beforehand before the packaging bag 1 is heated in the microwave oven.

3. Third Embodiment

FIGS. 16 and 17 are used to describe the third embodiment of the invention. The packaging bag 1 of this embodiment differs from the first embodiment in that it has a tool storage space 37 in the upper part of the top end welding portion 22 and an opening/closing member 23 in the lower part of the top end welding portion 22. The following description will focus on the differences.

As shown in FIG. 16, the packaging bag 1 of this embodiment has a tool housing space 37 above the upper end welded portion 22. The upper end of the tool storage space 37 is heat sealed, and the user can take out the tools 25 in the tool storage space 37 by opening the bag from the opening portion 37*b* formed at the edge in the left-right direction.

As shown in FIG. 17, an opening/closing member 23 of the same configuration as in the first perspective is formed at the bottom of the top end welding portion 22. In this form of packaging bag 1, a tool storage space 37 can be provided above the upper part of the upper end welded portion 22, and the convenience of the user can be improved in the same manner as in the above embodiment.

4. Fourth Embodiment

The fourth embodiment of the invention will be described using FIGS. 18 through 20. The packaging bag 1 of this embodiment differs from the first embodiment in that it has a handle 40 for holding the packaging bag 1 and a tool housing space 37 for storing tools 25 at the top of the top end welded portion 22. The following description will focus on the differences.

As shown in FIG. 18, the packaging bag 1 of this embodiment has a handle forming portion 41 formed at the top of the top end welding portion 22. In the center of the handle forming portion 41, an open hole is formed in the front-back direction that functions as a handle 40 for a user to grasp. Instead of the upper end welding portion 22, the upper end welding portion 22 may be configured to be opened and closed by the opening/closing member 23.

A tool storage space 37 for storing tools 25 is formed at the top of the handle formation 41. The user can easily carry the packaging bag 1 by grasping the handle 40 with each tool 25 stored in the tool storage space 37. Since the tools 25 are to be grasped in this embodiment, it is preferable to use tools that are less uneven, such as chopsticks, as shown in FIG. 18.

An outlet 37*a* for taking out the tools 25 is formed on one side of the tool housing space 37 in the left-right direction. This configuration makes it easy for the user to take the tools 25 in and out, thereby improving convenience.

As shown in FIG. 19, the tool storage space 37 can be formed in a simple configuration by folding the front portion 41*a* of the handle formation 41 backward and heat-sealing its top edge at the top of handle 40 (area D2 in FIG. 19).

As shown in FIG. 20, in the packaging bag 1 in this embodiment, the front 41*a* and rear 41*b* are folded back and forth to form opening 7, which allows the contents to be stored inside. The folded front 41*a* and rear 41*b* can then be put back together to form the top end welded portion 22 as shown in FIG. 18, and tools 25 can be stored in the tool storage space 37 from the take-out opening 37*a*.

5. Other Embodiments

The form of the packaging bag 1 is not limited to the above embodiments. For example, it can be a flat bag that is not self-standing and needs to be laid flat during heating, or it can be a box-shaped packaging bag.

Third Viewpoint

1. First Embodiment

1-1. Configuration of Packaging Bag 1

The packaging bag 1 of this viewpoint is similar to the packaging bag 1 of the first viewpoint, and the description in the first viewpoint also applies to the packaging bag 1 of this viewpoint, unless contrary to the intent of the first viewpoint. The basic configuration of the packaging bag 1 of this viewpoint is similar to that of the packaging bag 1 of the first viewpoint, but the packaging bag 1 of this viewpoint does not require the opening/closing member 23. The following explanation focuses on the differences.

The packaging bag 1 in this embodiment is sold with a solid substance inside, and is configured for use by the user who purchases the bag to pour water or other liquid into it and heat it.

As shown in FIGS. 21 and 22, the peripheral 21 of the packaging bag 1 is provided with an opening/closing member 23, a first opening 44 and a second opening 45. The configuration of the opening/closing member 23 is the same as in the first perspective.

The first opening section 44 and the second opening section 45 are the sections for opening the packaging bag 1. The first opening section 44 is located in the lower front 3*a*, and the second opening section 45 is located above the opening/closing member 23 (i.e., away from the bottom part 2) in the upper front 3*b*.

In this embodiment, the first opening portion 44 has a first tearing start 44*a*, which is the starting point for tearing the peripheral portion 21, and a first cut line 44*b* with a line printed on it indicating the portion where the opening is to be cut. The description of the first opening portion 44 is the same as the description of the opening portion 24 in the first perspective.

The second opening section 45 is constructed in the same manner as the first opening section 44, and is equipped with a second tear initiation section 45*a* and a second cut line 45*b*. By opening the packaging bag 1 at the second opening section 45, the user can inject water or other liquid inside. The contents can then be cooked by closing the opening/closing member 23 and heating in a microwave oven.

Reinforcing members 46 are attached to the inner surface of the circumferential portion 21 to reinforce the rigidity of the circumferential portion 21 over the circumferential portion 21. Details of the reinforcement member 46 are described below.

As shown in FIG. 21, when the contents are contained in the packaging bag 1, the top end of the packaging bag 1 has a top end welding portion 22 that welds the front portion 3 and the back portion 4.

The reinforcement member 46 is attached to the inner surface of the peripheral portion 21, which corresponds to the main body 6. In this embodiment, the reinforcement member 46 has its upper end 46*a* and lower end 46*b* welded to the inner surface of the peripheral portion 21. In this way, liquid injected into the packaging bag 1 can be prevented from entering the gap between the reinforcement member 46 and the peripheral portion 21. Although the reinforcement member 46 may be welded to the inner surface of the peripheral portion only at the lower end 46*b*, by welding the upper end 46*a* as well, the gap between the reinforcement member 46 and the peripheral portion 21 can be more securely prevented from being filled with liquid by the user.

The length H in the vertical direction of the reinforcement member 46 should be, for example, H/H2≥0.2 and H/H2≥0.3 relative to the length H2 in the vertical direction of the body part 6. Preferably, 0.7≥H/H2≥0.3, and more specifically, the value of H/H2 may be 0.20, 0.25, 0.30, 0.35, 0.40, 0.45, 0.50, 0.55, 0.60, 0.65, 0.70, and also within a range between any two of the values illustrated here It may also be between any two of the values illustrated here. The value of length H is between 2 and 9 cm, specifically, for example, 2, 3, 4, 5, 6, 7, 8, or 9 cm, and may be in the range between any two of the values illustrated here.

Referring to FIGS. 23*a* through 23*c*, the reinforcement member 46 is described in more detail. As shown in FIGS. 23A and 23B, the outer dimensions of the reinforcement member 46 match the inner dimensions of the body 6. In the example shown in FIG. 23C, the reinforcement member 46 is cylindrically formed. The reinforcement member 46 can be made of water-resistant paper, such as cardboard, or plastic. By attaching the reinforcement member 46 to the inner surface of the peripheral portion 21 in this manner, the peripheral portion 21 is reinforced, and the self-supporting stability and graspability of the packaging bag 1 are improved. In other words, since the purpose of the reinforcement member 46 in the packaging bag 1 is to provide self-supporting stability and graspability of the peripheral portion 21, it is not necessary to provide the reinforcement member 46 on the bottom portion 2.

Preferably, the reinforcement member 46 can be made of heat-resistant plastic as a heat insulator. In this way, the convenience of gripping the packaging bag 1 after heating is further improved. Welding of the reinforcement member 46 can be performed by laminating the surface of the reinforcement member 46 with a resin identical to the sealant layer of the film, such as LL (low density polyethylene).

The packaging bag 1 is manufactured by forming the bottom portion 2, front portion 3, and back portion 4 as shown in FIG. 6*a* of the first perspective, followed by inserting the openable member 23 and reinforcing member 46 between the front portion 3 and back portion 4 near the other end C2 of the ring C (near the top of the front portion 3 and back portion 4), as shown in FIG. 24, and welding the openable member 23 and reinforcing member 46 to the inner surfaces of the front portion 3 and back portion 4, respectively.

2. Second Embodiment

Referring to FIG. 25, the second embodiment of the invention is described. The packaging bag 1 of this embodiment differs from the first embodiment in that it is not equipped with a second opening portion 45 and an opening/closing member 23. The following explanation will focus on the differences.

The packaging bag 1 of this embodiment is sold with liquid inside and is intended to be used by the user who purchases the bag to heat it as it is. Therefore, the second opening portion 45 and the opening/closing member 23 are not required. In this form of packaging bag 1, user convenience can be improved in the same way as in the above embodiment.

3. Other Embodiments

The reinforcement 46 may be configured such that insulation is attached to a portion of the reinforcement 46. For example, the insulation may be attached to the center of the reinforcement member 46 in the vertical direction. In this case, it is preferable to attach the heat insulator between the reinforcement member 46 and the periphery 21.

In the above embodiment, the reinforcement member 46 is rectangular in plan view. For example, it may be formed in a convex shape that protrudes downward at the center in the left-right direction in plan view.

The reinforcement member 46 may have a crease extending in the vertical direction. In this way, it is easier to maintain the opening of the opening 7 after opening.

REFERENCE SIGNS LIST

1: packaging bag, 2: bottom surface portion, 3: front surface portion, 3*a*: lower front surface portion, 3*b*: upper front surface portion, 3*p*: first protruding portion, 3*q*: opening, 4: back surface portion, 4*p*: second protruding portion, 4*q*: opening, 5: tear-off portion, 6: main body portion, 7: opening, 10: joint portion, 10*a*: overlapping portion, 10*p*: protruding portion, 10*q*: opening, 11: vapor release seal portion, 12: side-edge welded portion, 12*a*: unwelded portion, 13: lower-edge welded portion, 13*a*: gradient portion, 13*b*: center portion, 14: air pocket, 15: fixed portion, 16: opening, 20*a*: bottom film, 20*b*: peripheral wall film, 21: peripheral surface portion, 22: upper-end welded portion, 23: openable member, 23*a*: front-side engagement member, 23*a*1: base portion, 23*a*2: hook portion, 23*b*: back-side engagement member, 23*b*1: base portion, 23*b*2: hook portion, 24: opening portion, 24*a*: tear start portion, 24*b*: tear-off line, 25: tool, 26: opening portion, 27: transparent portion, 28: drawing pattern, 29: tool accommodation portion, 36: sticking seal, 37: tool accommodation space, 37*a*: outlet, 37*b*: opening portion, 38: content storage space, 39: partition welded portion, 40: handle, 41: handle forming portion, 41*a*: front surface portion, 41*b*: rear surface portion, 44: first opening portion, 44*a*: first tear start portion, 44*b*: tear-off line, 45: second opening portion, 45*a*: second tear start portion, 45*b*: tear-off line, 46: reinforcement member, 46*a*: upper end portion, 46*b*: lower end portion, B: region, C: ring, C1: one end, C2: the other end, D2: region, E: center line, H4: Height, N2: vicinity region, R: notch, T: thickness, θ: angle

The invention claimed is:

1. A packaging bag for a microwave oven, wherein:

a flexible film is formed into a bag shape, a tool used when eating the contents in the packaging bag is attached, said packaging bag comprises a bottom portion, a front portion, a back portion, and an opening portion, the front portion and the back portion facing each other and rising from the bottom portion, a space for accommodating the tool is provided at either end of the packaging bag in the left-right direction, the space for accommodating the tool is separated from a space for accommodating the contents by a partition weldment formed by heat-sealing the front portion and the back portion in the vertical direction, the opening portion extends in a left-right direction so as to be perpendicular to the partition weldment and is configured to tear the partition weldment, and the opening portion includes a pair of tear start portions configured to serve as a starting point for tearing the front portion and the back portion, and the pair of tear start portions are disposed on both the left and right sides of the partition weldment, the packaging bag further comprising a joint portion that includes a vapor release seal portion, wherein the opening portion is provided closer to the bottom surface portion than the joint portion, and wherein the joint portion extends in a left-right direction so as to be perpendicular to the partition weldment.

2. The packaging bag of claim 1, wherein:

the front portion comprises a lower front portion and an upper front portion, the lower front portion is welded to the bottom portion, and the lower front portion and the upper front portion are welded to each other at the joint portion.

3. The packaging bag of claim 2, wherein the joint portion is formed by overlapping an inner surface of the lower front portion and an inner surface of the upper front portion in a state that the lower front portion and the upper front portion are both folded back.

4. The packaging bag of claim 1, wherein the vapor release portion extends in a left-right direction so as to be perpendicular to the partition weldment.

* * * * *